US010487649B2

(12) United States Patent
Tilke et al.

(10) Patent No.: US 10,487,649 B2
(45) Date of Patent: Nov. 26, 2019

(54) PROBABALISTIC MODELING AND ANALYSIS OF HYDROCARBON-CONTAINING RESERVOIRS

(71) Applicant: SCHLUMBERGER TECHNOLOGY CORPORATION, Sugar Land, TX (US)

(72) Inventors: Peter Tilke, Belmont, MA (US); Sandip Bose, Brookline, MA (US); Benoit Couet, Belmont, MA (US); Xuqing Wu, Sugar Land, TX (US); Smaine Zeroug, Lexington, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 112 days.

(21) Appl. No.: 14/670,040

(22) Filed: Mar. 26, 2015

(65) Prior Publication Data

US 2016/0281497 A1 Sep. 29, 2016

(51) Int. Cl.
*E21B 49/00* (2006.01)
*E21B 47/00* (2012.01)

(52) U.S. Cl.
CPC ..... *E21B 49/00* (2013.01); *E21B 47/00* (2013.01)

(58) Field of Classification Search
CPC ..... E21B 48/00; E21B 47/00
See application file for complete search history.

(56) References Cited

U.S. PATENT DOCUMENTS 6,408,290 B1 * 6/2002 Thiesson ..... G06K 9/6296 706/45
6,442,487 B2 * 8/2002 Kim ..... G01V 1/32 702/6
6,556,960 B1 * 4/2003 Bishop ..... G06F 17/18 700/28

(Continued)

FOREIGN PATENT DOCUMENTS

WO W09928832 A2 6/1999

OTHER PUBLICATIONS

Frank R. Kschischang et al, "Factor Graphs and the Sum-Product Algorithm", Feb. 2001, IEEE Transactions on Information Theory, vol. 47, No. 2, p. 498-519.*

(Continued)

*Primary Examiner* — Jay Hann
*Assistant Examiner* — Chuen-Meei Gan

(57) ABSTRACT

Methods and systems are provided for modeling an aspect of a hydrocarbon-containing reservoir by constructing a first factor graph having variables and factors that describe the aspect of the hydrocarbon-containing reservoir. The first factor graph is converted to a tree-structured graph that does not have any cycle or loops. The tree-structured graph is converted to a second factor graph that does not contain any cycles or loops, wherein the second factor graph has variables and factors that describe the aspect of the hydrocarbon-containing reservoir. A query on the second factor graph is carried out involving message passing operations that perform probabilistic inference on the second factor graph with regard to the aspect of the hydrocarbon-containing reservoir that is modeled by the second factor graph.

18 Claims, 25 Drawing Sheets

(56) References Cited

U.S. PATENT DOCUMENTS

| | | | | |
|---|---|---|---|---|
| 7,433,851 | B2 * | 10/2008 | Mirowski | G01V 1/30 367/25 |
| 7,743,006 | B2 | 6/2010 | Woronow et al. | |
| 8,775,358 | B2 * | 7/2014 | Bonawitz | G06N 7/005 706/52 |
| 2002/0116351 | A1 | 8/2002 | Skaanning et al. | |
| 2003/0220906 | A1 * | 11/2003 | Chickering | G06N 7/005 |
| 2005/0216496 | A1 * | 9/2005 | Chickering | G06N 7/005 |
| 2007/0011113 | A1 * | 1/2007 | Mosleh | G06N 7/005 706/14 |
| 2007/0226158 | A1 * | 9/2007 | Woronow | G01V 11/00 706/17 |
| 2009/0012746 | A1 * | 1/2009 | Kairo | G01V 99/00 702/181 |
| 2010/0084191 | A1 * | 4/2010 | Chapman | E21B 44/00 175/24 |
| 2012/0317060 | A1 | 12/2012 | Jebara | |

OTHER PUBLICATIONS

Andres Cano et al, "Heuristic Algorithms for the Triangulation of Graphs", Jul. 1994, Advances in Intelligent Computing—IPMU '94, SpringerLink. Item 10 p. 98-107.*

Sargur Srihari, Factor Graphs and Inference, Lecture Note p. 1-29, available online Nov. 28, 2011.*

Gabriele Martinelli, Jo Eidsvik, Dynamic exploration designs for graphical models using clustering with applications to petroleum exploration Knowledge-Based Systems 58 (2014) 113-126, Available online Aug. 28, 2013 (Year: 2013).*

Gabriele Martinelli , Jo Eidsvik, Building Bayesian networks from basin modeling scenarios for improved geological decision making Petroleum Geoscience (Year: 2012).*

Gabriele Martinelli, Jo Eidsvik , Ragnar Hauge, Dynamic decision making for graphical models applied to oil exploration European Journal of Operational Research 230 (2013) 688-702 (Year: 2013).*

John R. Fanchi, Integrating forward modeling into reservoir simulation, Journal of Petroleum Science and Engineering 32 (2001) 11-21 (Year: 2001).*

Lee et al., "Dynamic structure learning of factor graphs and parameter estimation of a constrained nonlinear predictive model for oilfield optimization", International Conference on Artificial Intelligence, 2010, pp. 633-639.

Loeliger, "An Introduction to Factor Graphs", IEEE Signal Processing Magazine, Jan. 2004, 14 pgs.

"Belief propagation", Wikipedia, Accessed Sep. 9, 2015, https://en.wikipedia.org/wiki/Belief_propagation, 8 pgs.

International Search Report and Written Opinion for corresponding PCT Application No. PCT/US2016/023906, dated Jul. 14, 2016, 8 pages.

* cited by examiner

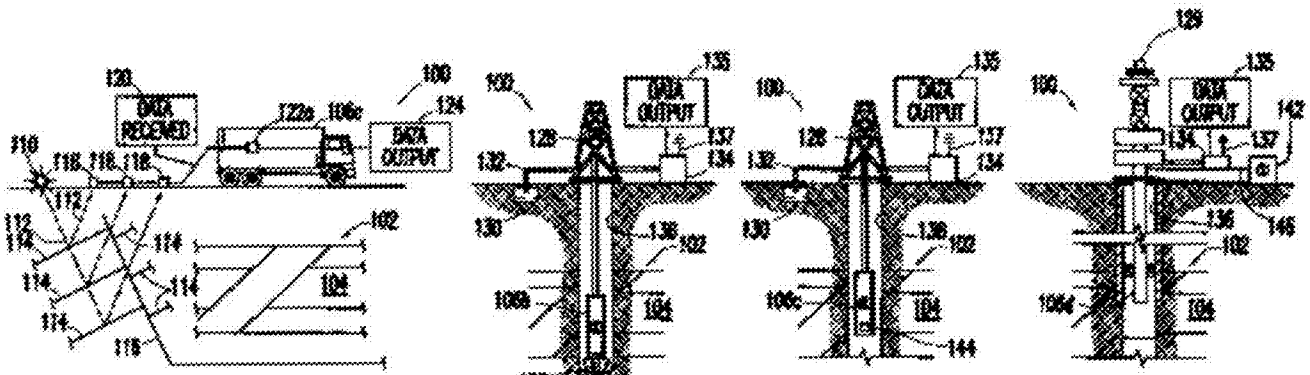
FIG. 1A
FIG. 1B
FIG. 1C
FIG. 1D
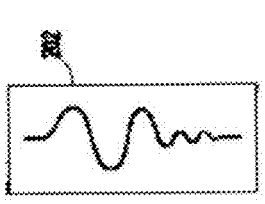
FIG. 2A
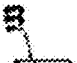
FIG. 2B
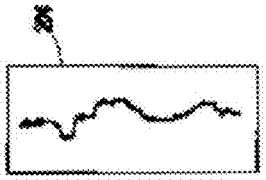
FIG. 2C
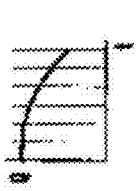
FIG. 2D

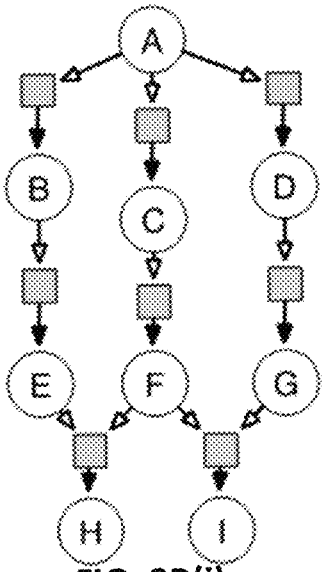
FIG. 8B(i)
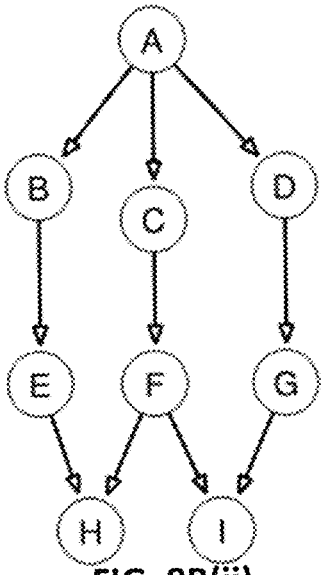
FIG. 8B(ii)
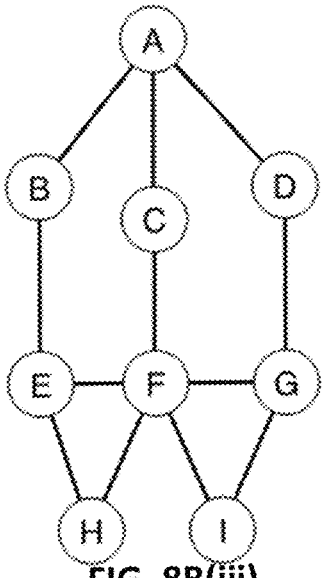
FIG. 8B(iii)
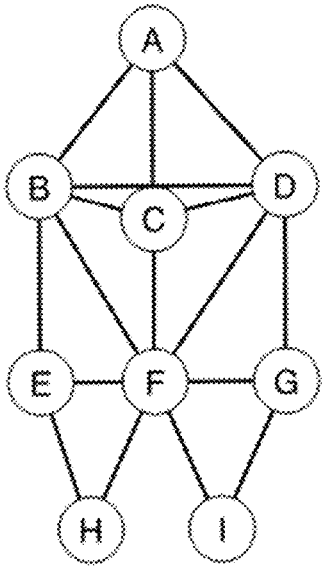
FIG. 8B(iv)
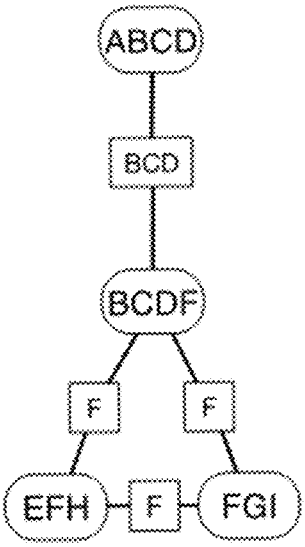
FIG. 8B(v)
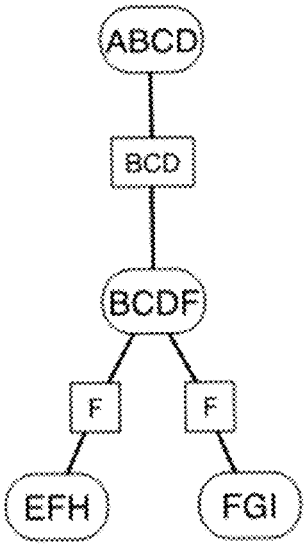
FIG. 8B(vi)

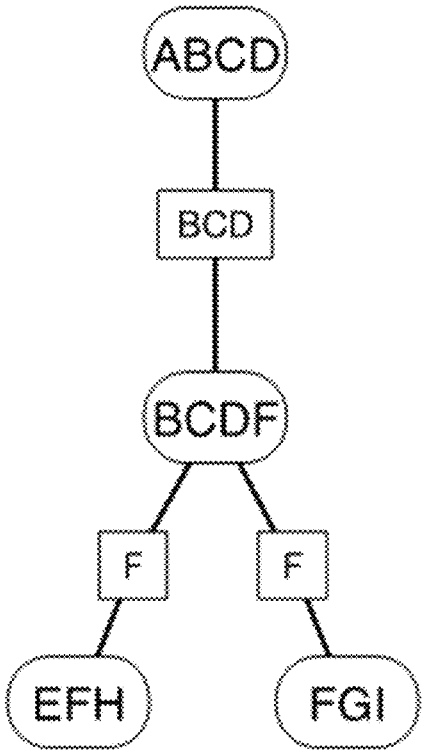
FIG. 8C(i)
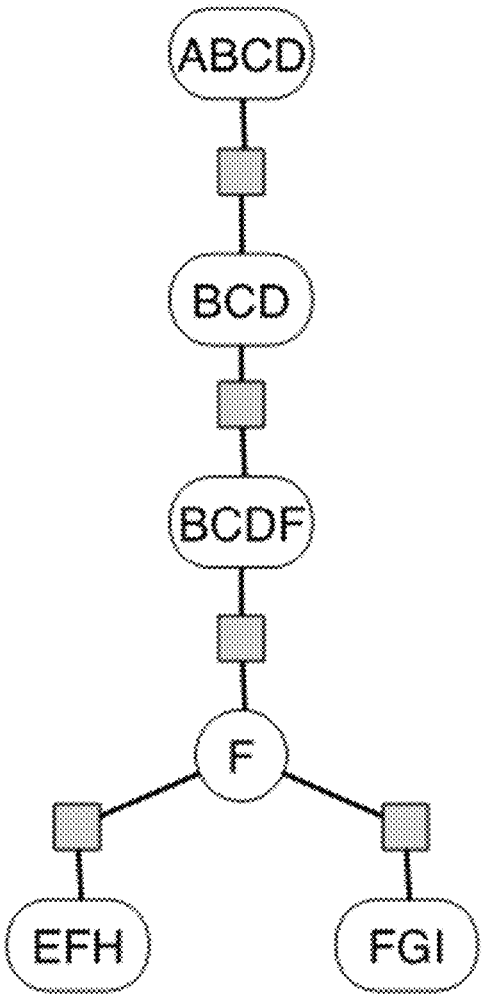
FIG. 8C(ii)

PROBABALISTIC MODELING AND ANALYSIS OF HYDROCARBON-CONTAINING RESERVOIRS

TECHNICAL FIELD

The subject disclosure relates to modeling techniques for analyzing subterranean formations having hydrocarbon-containing reservoirs therein.

BACKGROUND

Oilfield operations (such as surveying, drilling, wireline testing, completions, production, and planning and oilfield analysis) are typically performed to locate and gather valuable downhole hydrocarbon fluids (such as oil and natural gas). Various aspects of the oilfield and its related operations are shown in FIGS. 1A-1D. As shown in FIG. 1A, surveys are often performed using acquisition methodologies, such as seismic scanners to generate maps of underground structures. These structures are often analyzed to determine the presence of subterranean hydrocarbon fluids. This information is used to assess the underground structures and locate the formations containing the desired subterranean hydrocarbon fluids. Data collected from the acquisition methodologies may be evaluated and analyzed to determine whether such hydrocarbon fluids are present, and if they are reasonably accessible.

As shown in FIGS. 1B-1D, one or more wellsites may be positioned along the underground structures to gather hydrocarbon fluids from the subterranean reservoirs. The wellsites are provided with tools capable of locating and removing hydrocarbon fluids from the subterranean reservoirs. As shown in FIG. 1B, drilling tools are typically advanced from rigs and into the earth along a given path to locate the downhole hydrocarbon fluids. During the drilling operation, the drilling tool may perform downhole measurements to investigate downhole conditions. In some cases, as shown in FIG. 1C, the drilling tool is removed and a wireline tool is deployed into the wellbore to perform additional downhole testing. After the drilling operation is complete, the well may then be prepared for production. As shown in FIG. 1D, wellbore completions equipment is deployed into the wellbore to complete the well in preparation for the production of fluid therethrough. Fluid is then drawn from downhole reservoirs, into the wellbore and flows to the surface. Facilities are positioned at surface locations to collect the hydrocarbons from the wellsite(s). Fluid drawn from the subterranean reservoir(s) passes to the facilities via transport mechanisms, such as tubing.

Production can involve enhanced recovery techniques and/or stimulation processes that are performed to enhance the productivity of a well. Enhanced oil recovery can begin at any time during the productive life of an oil reservoir. Its purpose is not only to restore formation pressure, but also to improve oil displacement or fluid flow in the reservoir. The four major types of enhanced oil recovery operations are water flooding, chemical flooding (e.g., alkaline flooding or micellar-polymer flooding), miscible displacement (e.g., carbon dioxide injection or hydrocarbon injection), and thermal recovery (e.g., steamflooding steam-assisted gravity drainage, or in-situ combustion). Stimulation processes generally fall into two main groups, hydraulic fracturing processes and matrix processes. Hydraulic fracturing processes are performed above the fracture pressure of the reservoir formation and create a highly conductive flow path between the reservoir and the wellbore. Matrix processes are performed below the reservoir fracture pressure and generally are designed to restore the natural permeability of the reservoir following damage to the near-wellbore area. Stimulation in shale gas and shale oil reservoirs typically takes the form of hydraulic fracturing processes. Various equipments may be positioned about the oilfield to monitor oilfield parameters and/or to manipulate the oilfield operations.

During the oilfield operations, data is typically collected for analysis and/or monitoring of the oilfield operations. Such data may include, for example, subterranean formation, equipment, historical and/or other data. Data concerning the subterranean formation is collected using a variety of sources. Such formation data may be static or dynamic. Static data relates to, for example, formation structure and geological stratigraphy that define the geological structure of the subterranean formation. Dynamic data relates to, for example, fluids flowing through the geologic structures of the subterranean formation over time. Such static and/or dynamic data may be collected to learn more about the formations and the valuable assets contained therein.

Sources used to collect static data may be seismic tools, such as a seismic truck that sends compression waves into the earth as shown in FIG. 1A. These waves are measured to characterize changes in the density of the geological structure at different depths. This information may be used to generate basic structural maps of the subterranean formation. Other static measurements may be gathered using core sampling and well logging techniques. Core samples may be used to take physical specimens of the formation at various depths as shown in FIG. 1B. Well logging typically involves deployment of a downhole tool into the wellbore to collect various downhole measurements, such as density, resistivity, etc., at various depths. Such well logging may be performed using, for example, the drilling tool of FIG. 1B and/or the wireline tool of FIG. 1C. Once the well is completed, fluid flows to the surface using tubing as shown in FIG. 1D. As fluid passes to the surface, various dynamic measurements, such as fluid flow rates, pressure, and composition may be monitored. These parameters may be used to determine various characteristics of the subterranean formation.

Sensors may be positioned about the oilfield to collect data relating to various oilfield operations. For example, sensors in the drilling equipment may monitor drilling conditions, sensors in the wellbore may monitor fluid composition, sensors located along the flow path may monitor flow rates, and sensors at the processing facility may monitor fluids collected. Other sensors may be provided to monitor downhole, surface, equipment or other conditions. The monitored data is often used to make decisions at various locations of the oilfield at various times. Data collected by these sensors may be further analyzed and processed. Data may be collected and used for current or future operations. When used for future operations at the same or other locations, such data may sometimes be referred to as historical data.

The processed data may be used to predict various aspects of the reservoir (such as downhole conditions of the reservoir) and make decisions concerning oilfield operations with respect to the reservoir. Such decisions may involve well planning, well targeting, well completions, operating levels, simulation rates and other operations and/or conditions. Often this information is used to determine when to drill new wells, re-complete existing wells, or alter wellbore production.

Data from one or more wellbores may be analyzed to plan or predict various outcomes at a given wellbore. In some cases, the data from neighboring wellbores or wellbores with similar conditions or equipment may be used to predict how a well will perform. There are typically a large number of variables and large quantities of data to consider in analyzing oilfield operations. It is, therefore, often useful to model the behavior of a reservoir and/or associated oilfield operations to determine the desired course of action. During the ongoing operations, the operating conditions may need adjustment as conditions change and new information is received.

Techniques have been developed to model the behavior of various aspects of a reservoir and associated oilfield operations, such as geological structures, downhole reservoirs, wellbores, surface facilities as well as other portions of the oilfield operation. Examples of these modeling techniques are shown in patent/Publication/application Nos. U.S. Pat. No. 5,992,519, WO2004/049216, WO1999/064896, WO2005/122001, U.S. Pat. No. 6,313,837, US2003/0216897, US2003/0132934, US2005/0149307, US2006/0197759, U.S. Pat. No. 6,980,940, US2004/0220846, and Ser. No. 10/586,283. Techniques have also been developed for performing reservoir simulation operations. See, for example, patent/Publication/application Nos. U.S. Pat. Nos. 6,230,101, 6,018,497, 6,078,869, GB2336008, U.S. Pat. No. 6,106,561, US2006/0184329, U.S. Pat. No. 7,164,990.

Despite the development and advancement of reservoir simulation techniques, there remains a need to consider the effects of uncertainty in computational models of reservoirs and associated oilfield operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Methods and associated computational systems/frameworks are provided for modeling an aspect of a hydrocarbon-containing reservoir by constructing a first factor graph having variables and factors that describe the aspect of the hydrocarbon-containing reservoir. The first factor graph is converted to a tree-structured graph that does not have any cycle or loops. The tree-structured graph is converted to a second factor graph that does not contain any cycles or loops, wherein the second factor graph has variables and factors that describe the aspect of the hydrocarbon-containing reservoir. A query on the second factor graph is carried out involving message passing operations that perform probabilistic inference on the second factor graph with regard to the aspect of the hydrocarbon-containing reservoir that is modeled by the second factor graph.

In some examples, a subset of the variables of the second factor graph are probabilistic variables that account for uncertainty associated therewith. The message passing operations can be configured to update the probabilistic variables of the second factor graph based on the factors of the second factor graph.

In some examples, the probabilistic inference performed on the second factor graph can involve one or more of the following: i) the computation of a marginal distribution of a single probabilistic variable; ii) the joint distribution of several probabilistic variables; and iii) drawing random samples from a probability distribution with respect to the probabilistic variables of the second factor graph.

In some examples, the query that operates on the second factor graph can be any one of the following types: i) a probability of evidence query; ii) a marginalization query; iii) a maximum posterior hypothesis query; iv) a most probable explanation query; v) a sensitivity analysis; and vi) an analysis that compares hypotheses.

In some examples, the value for at least one variable of the second factor graph can be derived from oilfield operations carried out with respect to the hydrocarbon-containing reservoir. The results of the probabilistic inference on the second factor graph may be used for decision making with regard to the aspect of the hydrocarbon-containing reservoir that is modeled by the second factor graph while accounting for uncertainty therein.

In accordance with some examples a system includes a processor and a memory. The memory stores instructions executable by the processor to perform processes that include: converting a first factor graph to a tree-structured graph that does not have any cycle or loops, wherein the first factor graph includes variables and factors that describe the aspect of the hydrocarbon-containing reservoir; converting the tree-structured graph to a second factor graph that does not contain any cycles or loops, the second factor graph having variables and factors that describe the aspect of the hydrocarbon-containing reservoir; and processing a query on the second factor graph, the processing of the query involving message passing operations that perform probabilistic inference on the second factor graph with regard to the aspect of the hydrocarbon-containing reservoir that is modeled by the second factor graph.

Additional aspects and examples of the disclosed methods and systems may be understood with reference to the following detailed description taken in conjunction with the provided drawings.

BRIEF DESCRIPTION OF THE DRAWINGS

FIGS. 1A-1D show example schematic views of an oilfield having subterranean structures including reservoirs therein and various oilfield operations being performed on the oilfield. FIG. 1A depicts an example survey operation being performed by a seismic truck. FIG. 1B depicts an example drilling operation being performed by a drilling tool suspended by a rig and advanced into the subterranean formation. FIG. 1C depicts an example of a wireline operation being performed by a wireline tool suspended by the rig and into the wellbore of FIG. 1B. FIG. 1D depicts an example of a production operation being performed by a production tool that is deployed from a rig into a completed wellbore for drawing fluid from the downhole reservoir to a surface facility.

FIGS. 2A-2D are examples graphical depictions of data collected by the tools of FIGS. 1A-1D, respectively. FIG. 2A depicts an example of a seismic trace of the subterranean formation of FIG. 1A. FIG. 2B depicts an example of a core sample of the formation shown in FIG. 1B. FIG. 2C depicts an example of a well log of the subterranean formation of FIG. 1C. FIG. 2D depicts an example of a production decline curve of fluid flowing through the subterranean formation of FIG. 1D.

FIGS. 8B(i)-8B(vi) depict various stages of the operations of FIG. 8A that convert a Factor Graph to a Junction Tree.

FIGS. 8C(i)-8C(ii) depict various stages of the operations of FIG. 8A that convert the resultant Junction Tree to a Factor Graph without cycles.

DETAILED DESCRIPTION

Figure 3:
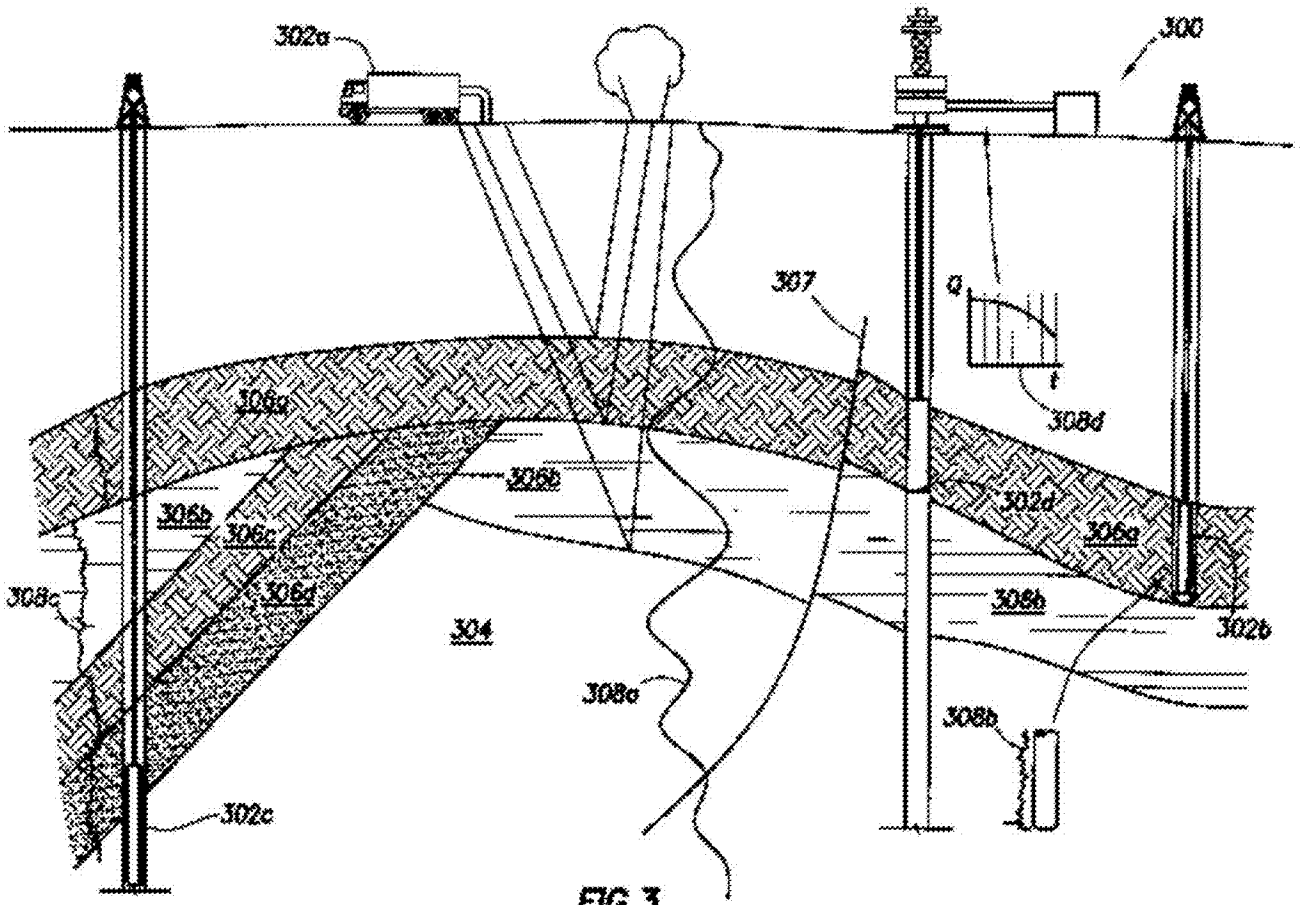
FIG. 3 shows a schematic view, partially in cross section, of an oilfield having a plurality of data acquisition tools positioned at various locations along the oilfield for collecting data from the subterranean formation.

The particulars shown herein are by way of example and for purposes of illustrative discussion of the examples of the subject disclosure only and are presented in the cause of providing what is believed to be the most useful and readily understood description of the principles and conceptual aspects of the subject disclosure. In this regard, no attempt is made to show details in more detail than is necessary, the description taken with the drawings making apparent to those skilled in the art how the several forms of the subject disclosure may be embodied in practice. Furthermore, like reference numbers and designations in the various drawings indicate like elements.

FIGS. 1A-D show an oilfield having geological structures and/or subterranean formations therein. As shown in these figures, various measurements of the subterranean formation are taken by different tools at the same location. These measurements may be used to generate information about the formation and/or the geological structures and/or fluids contained therein.

FIGS. 1A-1D depict schematic views of an oilfield 100 having subterranean formations 102 containing a reservoir 104 therein and depicting various oilfield operations being performed on the oilfield 100. FIG. 1A depicts a survey operation being performed by a seismic truck 106*a* to measure properties of the subterranean formation. The survey operation is a seismic survey operation for producing sound vibrations. In FIG. 1A, one such sound vibration 112 is generated by an acoustic source 110 and reflects off a plurality of horizons 114 in an earth formation 116. The sound vibration(s) 112 is (are) received in by sensors, such as geophone-receivers 118 situated on the earth's surface. The sensors (e.g., geophone-receivers 118) produce electrical output signals which are labeled as "Data Received" 120 in FIG. 1A. Such electrical output signals are representative of different parameters (such as amplitude and/or frequency) of the sound vibration(s) 112, and such electrical signals are provided as input data to a data processor (e.g., computer) 122*a* of the seismic recording truck 106*a*). The recording truck computer 122*a* generates a seismic data output record (labeled "Data Output" 124) responsive to the input data signals. The seismic data output record may be further processed as desired, for example by data reduction.

FIG. 1B depicts a drilling operation being performed by a drilling tool 106*b* suspended by a rig 128 and advanced into the subterranean formation 102 to form a wellbore 136. A mud pit 130 is used to draw drilling mud into the drilling tool 106*b* via flow line 132 for circulating drilling mud through the drilling tool 106*b* and back to the surface. The drilling tool 106*b* is advanced into the formation to reach the reservoir 104. The drilling tool 106*b* can be adapted to measure downhole properties. The drilling tool 106*b* can also be adapted for taking one or more core samples (one shown as 133), or can be removed so that a core sample may be taken using another tool.

A surface unit 134 can be used to communicate with the drilling tool 106*b* and offsite operations. The surface unit 134 is capable of communicating with the drilling tool 106*b* to send commands to drive the drilling tool 106*b*, and to receive data therefrom. Sensors, such as temperature sensors, pressure sensors, stain sensors and flow meters, may be positioned throughout the reservoir, rig, oilfield equipment (such as the downhole tool), or other portions of the oilfield for gathering information about various parameters, such as surface parameters, downhole parameters, and/or operating conditions. These sensors can be configured to measure oilfield parameters during the drilling operation, such as weight on bit, torque on bit, pressures, temperatures, flow rates, compositions and other parameters of the drilling operation. The surface unit 134 can be provided with computer facilities for receiving, storing, processing, and analyzing data collected by the sensors positioned throughout the oilfield 100 during the drilling operations.

Computer facilities, such as those of the surface unit 134, may be positioned at various locations about the oilfield 100 and/or at remote locations. One or more surface units 134 may be located at the oilfield 100, or linked remotely thereto. The surface unit 134 may be a single unit, or a complex network of units used to perform the data management functions throughout the oilfield 100. The surface unit 134 may be a manual or automatic system. The surface unit 134 may be operated and/or adjusted by a user. The surface unit 134 may be provided with a transceiver 137 to allow communications between the surface unit 134 and various portions of the oilfield 100 or other locations. The surface unit 134 may also be provided with or functionally linked to a controller for actuating mechanisms at the oilfield. The surface unit 134 may then send command signals to the oilfield 100 in response to data received. The surface unit 134 may receive commands via the transceiver or may itself execute commands to the controller. A processor may be provided to analyze the data (locally or remotely) and make the decisions to actuate the controller. In this manner, the oilfield 100 may be selectively adjusted based on the data collected to optimize fluid recovery rates, or to maximize the longevity of the reservoir and its ultimate production capacity. These adjustments may be made automatically based on computer protocol, or manually by an operator. In some cases, well plans may be adjusted to select optimum operating conditions, or to avoid problems.

FIG. 1C depicts a wireline operation being performed by a wireline tool 106*c* suspended by the rig 126 into the wellbore 126 of FIG. 1B. The wireline tool 106*c* can be adapted for deployment into a wellbore 136 for performing well logs, performing downhole tests and/or collecting samples. The wireline tool 106*c* may be used to provide another method and apparatus for performing a seismic survey operation. For example, the wireline tool 106*c* may be operatively linked to the data computer 122*a* of the seismic recording truck 106*a* of FIG. 1A. The wireline tool 106*c* may also provide data (labeled "Data Output" 135) to the surface unit 134. The wireline tool 106*c* may be positioned at various depths in the wellbore 136 to provide a survey of the subterranean formation.

FIG. 1D depicts production operations performed by a production tool 106*d* deployed from the rig 128 into the completed wellbore 136 of FIG. 1C for drawing fluid from the downhole reservoirs into surface facilities 142. Fluid flows from reservoir 104 through wellbore 136 and to the surface facilities 142 via a gathering network 144. Sensors can be positioned about the oilfield 100 and operatively coupled to the surface facilities 142 for collecting data therefrom. During the production process, data collected from various sensors (labeled "Data Output" 135) can be passed to the surface unit 134 and/or processing facilities. This data may be, for example, reservoir data, wellbore data, surface data, and/or process data.

As previously described, sensors, surface equipment and downhole tools can be used to collect data relating to various oilfield operations. This data may be collected by the surface unit 34 and/or other data collection sources for analysis or other processing. The data collected by the sensors, surface equipment and downhole tools may be used alone or in combination with other data. The data may be collected in a database and all or select portions of the data may be selectively used for analyzing and/or predicting oilfield operations of the current and/or other wellbores. The data may be historical data, real time data, or combinations thereof. The data may also be combined with historical data or other inputs for further analysis. The data may be housed in separate databases, or combined into a single database.

The collected data may be used to perform analysis, such as modeling operations. For example, the seismic data output may be used to perform geological, geophysical, reservoir engineering, and/or production simulations. The reservoir, wellbore, surface and/or process data may be used to perform reservoir, wellbore, or other production simulations, planning analyses, and optimizations.

While simplified wellsite configurations are shown, it will be appreciated that the oilfield may cover a portion of land, sea and/or water locations that hosts one or more wellsites. Production may also include injection wells (not shown) for added recovery. One or more gathering facilities may be operatively connected to one or more of the wellsites for selectively collecting downhole fluids from the wellsite(s).

While certain data acquisition tools are depicted in FIGS. 1A-1D, it will be appreciated that various measurement tools capable of sensing parameters, such as seismic two-way travel time, density, resistivity, production rate, etc., of the subterranean formation and/or its geological formations may be used. Various sensors may be located at various positions along the wellbore and/or the monitoring tools to collect and/or monitor the desired data. Other sources of data may also be provided from offsite locations.

The oilfield configuration in FIGS. 1A-1D are intended to provide a brief description of an example of an oilfield applicable to example embodiments of the present invention. Part, or all, of the oilfield 100 may be on land and/or sea. Also, while a single oilfield measured at a single location is depicted, the present invention may be used with any combination of one or more oilfields 100, one or more processing facilities, and one or more wellsites.

FIGS. 2A-2D are graphical depictions of data collected by the surface equipment and downhole tools of FIGS. 1A-D, respectively. FIG. 2A depicts a seismic trace 202 of the subterranean formation taken by the seismic truck 106*a* of FIG. 1A. The seismic trace measures a two-way response over a period of time. FIG. 2B depicts a core sample 133 obtained by the drilling tool 106*b* of FIG. 1B. The core sample 133 can be tested to provide a measure of the density, resistivity, porosity, or other physical property of the core sample 133. Tests for density and viscosity are often performed on the fluids in the core at varying pressures and temperatures. FIG. 2C depicts a well log 204 of the subterranean formation taken by the wireline tool 106*c* of FIG. 1C. The wireline log typically provides a measurement of resistivity and possibly other physical properties of the formation at various depts. FIG. 2D depicts a production decline curve 206 of fluid flowing through the subterranean formation via the production tool 106*d* of FIG. 1D. The production decline curve 206 typically provides the production rate Q as a function of time t.

The respective graphs of FIGS. 2A and 2C contain static measurements that describe the physical characteristics of the formation. These measurements may be compared to determine the accuracy of the measurements and/or for checking for errors. In this manner, the plots of each of the respective measurements may be aligned and scaled for comparison and verification of the properties. FIG. 2D provides a dynamic measurement of the fluid properties through the wellbore. As the fluid flows through the wellbore, measurements are taken of fluid properties, such as flow rates, pressures, composition, etc. As described below, the static and dynamic measurements may be used to generate computational models of the subterranean formation to determine characteristics thereof.

FIG. 3 is a schematic view, partially in cross section of an oilfield 300 having data acquisition tools 302*a*, 302*b*, 302*c*, and 302*d* positioned at various locations along the oilfield for collecting data of a subterranean formation 304. The data acquisition tools 302*a*-302*d* may be the same as data acquisition tools 106*a*-106*d* of FIGS. 1A-1D, respectively. As shown, the data acquisition tools 302*a*-302*d* generate data plots or measurements 308*a*-308*d*, respectively. The data plots 308*a*-308*c* are examples of static data plots that may be generated by the data acquisition tools 302*a*-302*d*, respectively. Static data plot 308*a* is a seismic two-way response time and may be the same as the seismic trace 202 of FIG. 2A. Static plot 308*b* is measured from a core sample of the formation 304, similar to the core sample 133 of FIG. 2B. Static data plot 308*c* is a logging trace, similar to the well log 204 of FIG. 2C. Data plot (308*d*) is a dynamic data plot of the fluid flow rate over time, similar to the graph 206 of FIG. 2D. Other data may also be collected, such as historical data, user inputs, economic information, other measurement data, and other parameters of interest.

The subterranean formation 304 has a plurality of geological structures 306*a*-306*d*. As shown, the formation has a sandstone layer 306*a*, a limestone layer 306*b*, a shale layer 306*c*, and a sand layer 306*d*. A fault 307 extends through the formation. The static data acquisition tools can be adapted to measure the formation and detect the characteristics of the geological structures of the formation.

While a specific subterranean formation 304 with specific geological structures are depicted, it will be appreciated that the formation may contain a variety of geological structures. Fluid may also be present in various portions of the formation. Each of the measurement devices may be used to measure properties of the formation and/or its underlying structures. While each acquisition tool is shown as being in specific locations along the formation, it will be appreciated that one or more types of measurement may be taken at one or more location across one or more oilfields or other locations for comparison and/or analysis.

The data collected from various sources, such as the data acquisition tools of FIG. 3, may then be evaluated. Typically, seismic data displayed in the static data plot 308*a* from the data acquisition tool 302*a* is used by a geophysicist to determine characteristics of the subterranean formation 304. Core data shown in static plot 308*b* and/or log data from the well log 308*c* is typically used by a geologist to determine various characteristics of the geological structures of the subterranean formation 304 and fluids contained therein. Production data from the production graph 308*d* is typically used by the reservoir engineer to determine fluid flow reservoir characteristics.

To facilitate characterization and analysis of a reservoir (and/or possibly oilfield operations associated therewith), one or more computational models and an associated data processing platform can be configured to process all or part of the data collected from the various sources as described herein. The computational model(s) can be based on functional relationships between variables that represent aspects of the reservoir being modeled. There are often uncertainties in the collected data, which may reflect confidence in the measuring equipment, noise in the data or the like. Such uncertainties can be represented in the computational model(s) by probability density functions reflecting the probability that certain variables have particular values. The computational model(s) is often derived from domain knowledge, such as knowledge of scientist(s), engineer(s), and/or economist(s) that have a good idea how the reservoir functions. That is, they may know that if variable A changes, it will cause a change in variable B by a predictable amount, with greater or lesser certainty. This domain knowledge may be available for all critical variables in the domain, allowing the causal links between them to be defined. This form of information can be exploited, for example, in defining the computational model(s) of the reservoir as well as in sensitivity analyses that uses such computational model(s) and in determining the value of information that is produced from the computational model(s).

In one aspect, a Factor Graph can be used as part of a computational model (and associated computational framework) that describes aspects of a reservoir of interest. A Factor Graph is a bipartite graph composed of two sets of nodes with directed edges extending between the two sets of nodes. One set of nodes are variables which represent probabilistic or uncertain measurements, natural phenomena, model parameters and interventions with respect to the reservoir of interest. The other set of nodes are factors which represent operators that transform input probabilistic variables to output probabilistic variables. Each factor can be connected to many variables. For example, if a factor node is connected to two variables nodes A and B, a possible factor operator could be imply(A,B), meaning that if the random variable A takes value 1, then so must the random variable B. The factor operators can have weight data associated with it, which describes how much influence the factor has on its variables in relative terms. In other words, the weight encodes the confidence in the relationship expressed by the factor operator. If the weight is high and positive, there is very high confidence in the operator that the factor encodes. On the other hand, if the weight is high and negative, there is very little confidence in the operator that the factor encodes. The weight data can be learned from training data, or assigned manually.

Figure 4A:
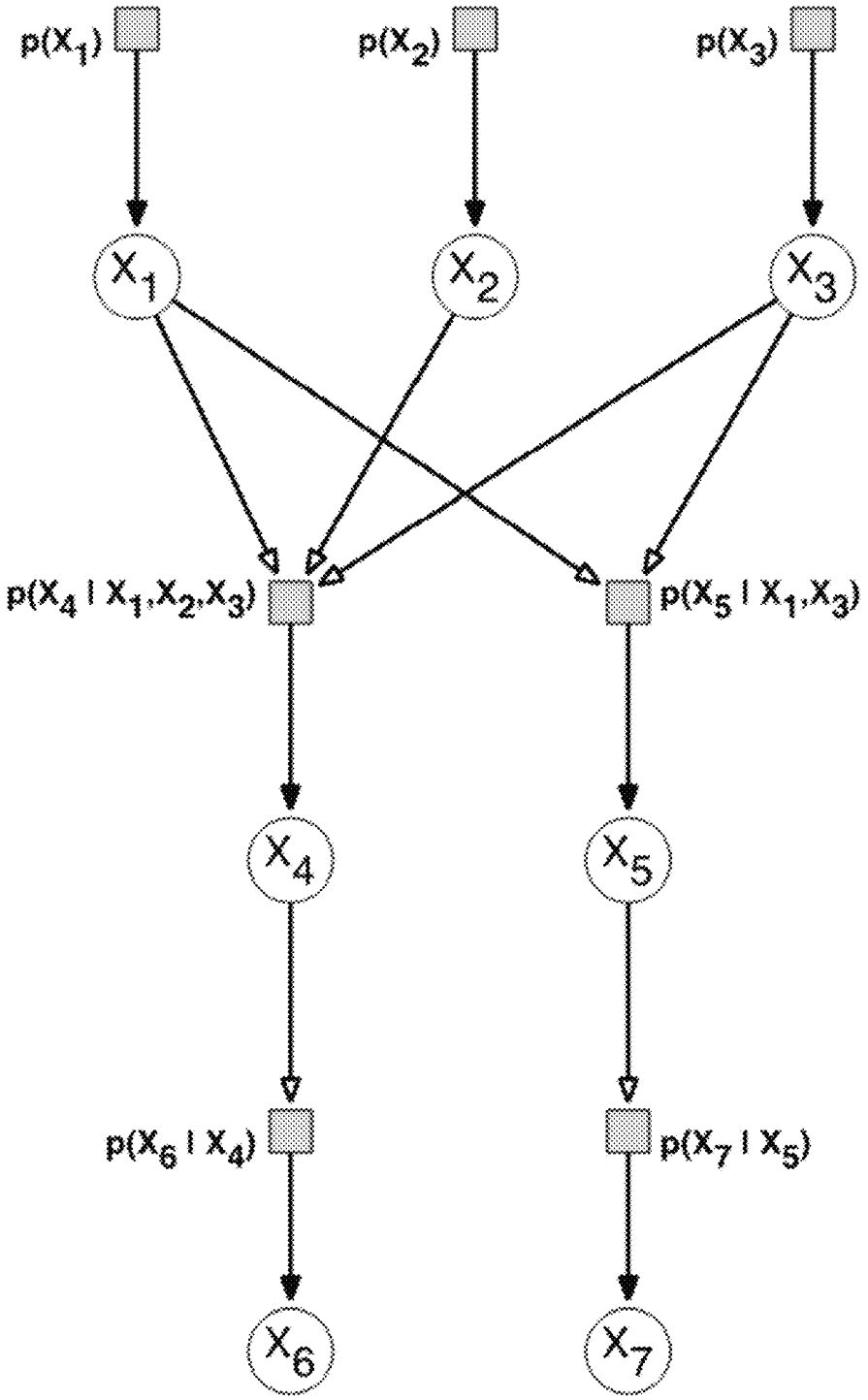
FIG. 4A is an exemplary Factor Graph in accordance with an aspect of the present disclosure.
Figure 4B:
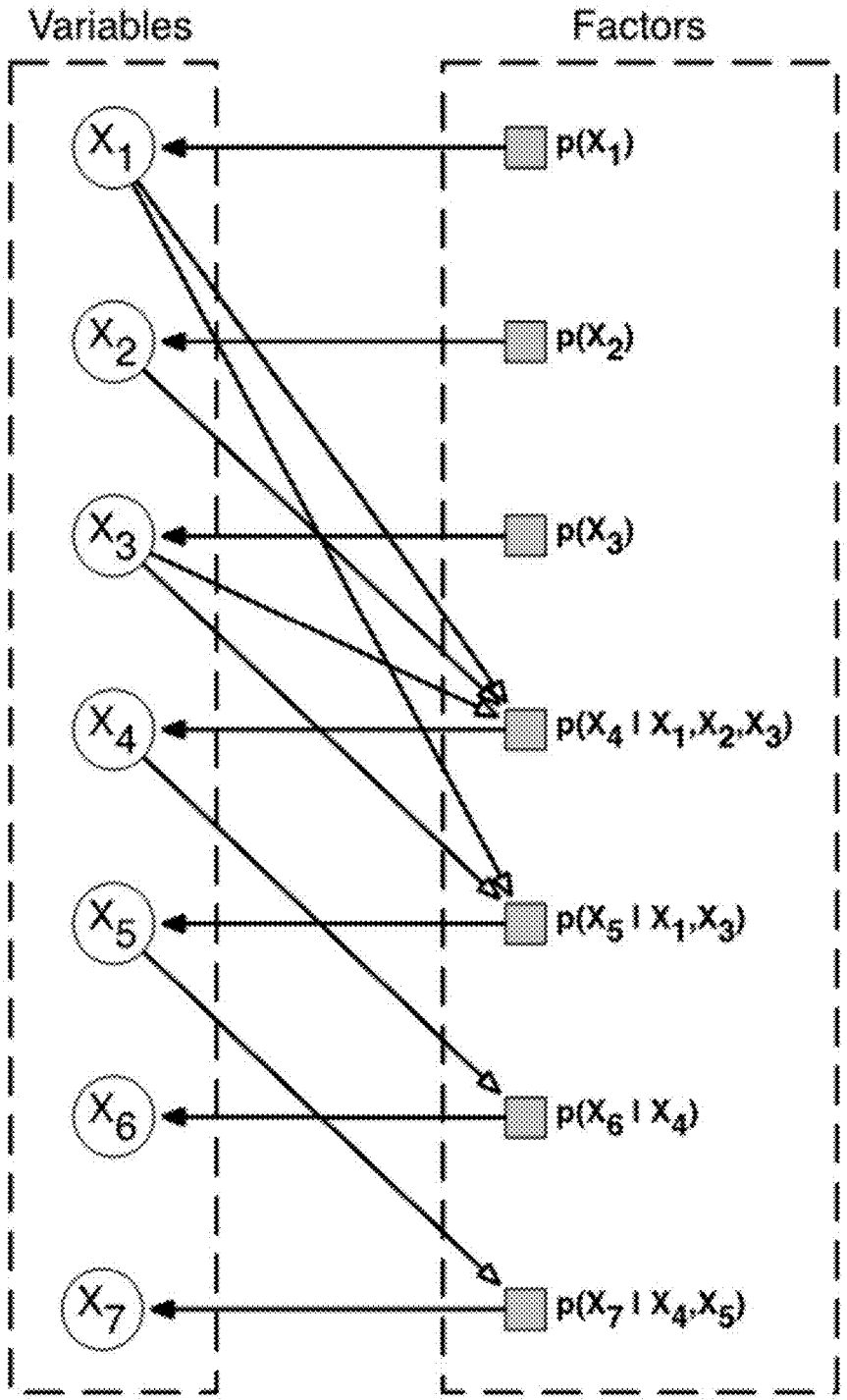
FIG. 4B is an alternate arrangement of the Factor Graph of FIG. 4A with the variables grouped on the left side of the page and the factors grouped on the right side of the page.

It is common for a circular shape to represent a variable and a square shape to represent a factor in the Factor Graph. The directed edges extending between the two sets of nodes can include one or more directed edges entering a given factor and a directed edge that exits a given factor. The directed edge(s) that enter a given factor, which relates the parent variable(s) to the given factor, is commonly represented by an arrow with an open head. The directed edge that exits a given factor, which relates the given factor to a variable computed by the given factor, is commonly represented by an arrow with a closed head. An exemplary Factor Graph is shown in FIG. 4A. The Factor Graph can be drawn to emphasize the bipartite nature of the Factor Graph with variable nodes grouped together and the factor nodes grouped together. For example, FIG. 4B shows the variable nodes grouped together on the left side of the page and the factor nodes grouped together on the right side of the page. Because a Factor Graph decouples variables from factors, the Factor Graph enables a probabilistic reasoning problem to be formulated in an extensible framework with multiple sub-graphs for different components of the problem.

Figure 5A:
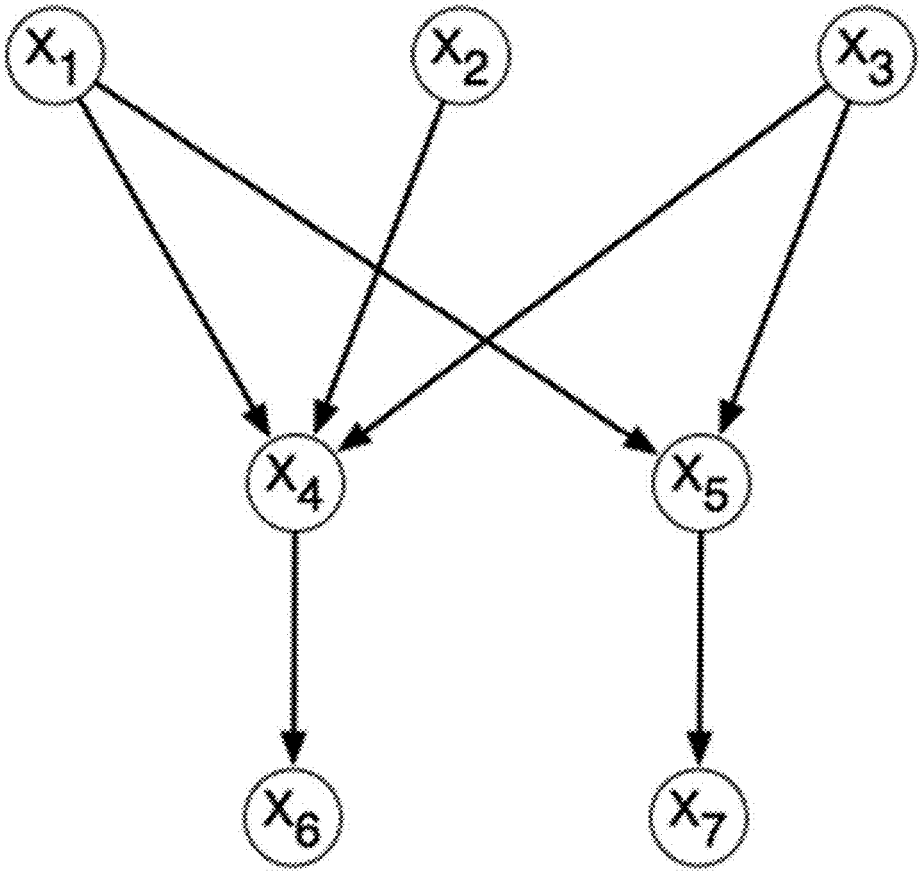
FIG. 5A shows an example Bayesian network that is realized by the Factor Graph of FIGS. 4A and 4B.

The Factor Graph can be used to represent a Bayesean Network for a hydrocarbon-containing reservoir system. A Bayesian Network is a directed acyclic graph (DAG) with nodes representing the variables of the system (in this case, a hydrocarbon-containing reservoir system) as well as directed edges representing the conditional relationships between the variables from conditioning (parent) nodes to conditioned (child) nodes. Each variable may have a set of mutually exclusive states, in which case they are discrete variables. A classic Bayesian Network is illustrated in FIG. 5A. In this network, each variable has two states and each variable has a set of probabilities representing the probability of the variable being in one of its states. Note that the Factor Graphs of FIGS. 4A and 4B represent the Bayesian Network of FIG. 5A. The joint probability distribution of the Bayesian Network of FIG. 5A is factorized as follows:

$$p(X_1,X_2,X_3,X_4,X_5,X_6,X_7)=p(X_1)p(X_2)p(X_3)p(X_4|X_1,X_2,X_3)\,p(X_5|X_1,X_3)p(X_6|X_4)p(X_7|X_5) \quad (1)$$

The relationship between these probabilities and those of its parents (conditioning variables) can be represented by a Conditional Probability Table (CPT), which can be quite large as the number of columns equals the number of states of the current variable and the number of rows represents the number of permutations of all the parents' states. Minimizing the size of the CPT is a challenge when designing inference and elicitation strategies.

A variable may take on continuous values over a range. This continuous property can be discretized into intervals within the range that can then be assigned to states, or the continuity can be modeled as a Probability Density Function (PDF.) Other strategies are then available for propagating probabilities through the network such as Gibbs sampling or variational methods.

A powerful feature of representing conditional probability problems as Bayesian Networks with the property of being Directed Acyclic Graphs (DAG) is that rules of conditional dependence and independence can be defined. Specifically, when influence can flow from X to Y via Z, the trail $X \leftrightarrows Z \leftrightarrows Y$ is active.

Figure 5B:
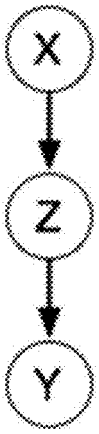
FIG. 5B shows a causal trail of an example Bayesian network.
Figure 5C:
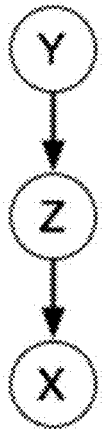
FIG. 5C shows an evidential trail of an example Bayesian network.
Figure 5D:
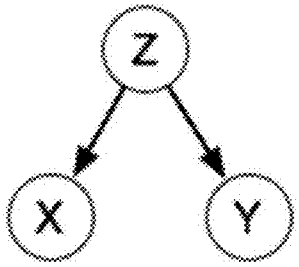
FIG. 5D shows a common cause of an example Bayesian network.
Figure 5E:
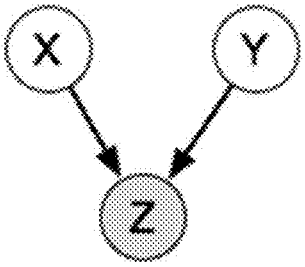
FIG. 5E shows a common effect of an example Bayesian network.
Figure 5F:
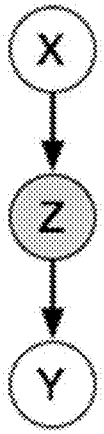
FIGS. 5F-5I show D-separated (conditionally independent) variables of an example Bayesian network.
Figure 5G:
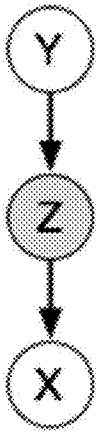
Figure 5H:
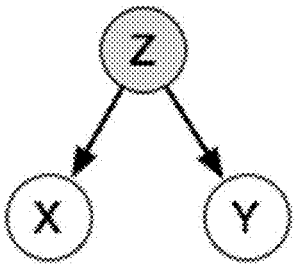

The results of this analysis for active two-edge trails are illustrated in FIGS. 5B-5E and can be summarized as follows:

- FIG. 5B shows a causal trail $X \rightarrow Z \rightarrow Y$, which is active if and only if Z is not observed.
- FIG. 5C shows an evidential trail $X \leftarrow Z \leftarrow Y$, which is active if and only if Z is not observed.
- FIG. 5D shows a common cause $X \leftarrow Z \rightarrow Y$, which is active if and only if Z is not observed.
- FIG. 5E shows a common effect $X \rightarrow Z \leftarrow Y$, which is active if and only if either Z or one of Z's descendants is observed.

Figure 5I:
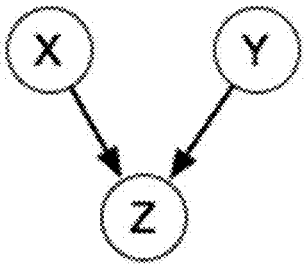

X and Y are dependent in FIGS. 5B, 5C and 5D because Z is not observed. In FIG. 5E, X and Y are dependent because Z is observed. If there does not exist an active trail between X and Y, then the two variables are said to be D-separated and conditionally independent (i.e., $X \perp Y|Z$). D-separated (conditionally independent) examples are illustrated in FIGS. 5F-5I. X and Y are conditionally independent in FIGS. 5F, 5G and 5H because Z is observed. In FIG. 5I, X and Y are also independent because neither Z nor any of its descendants is observed.

Figure 6:
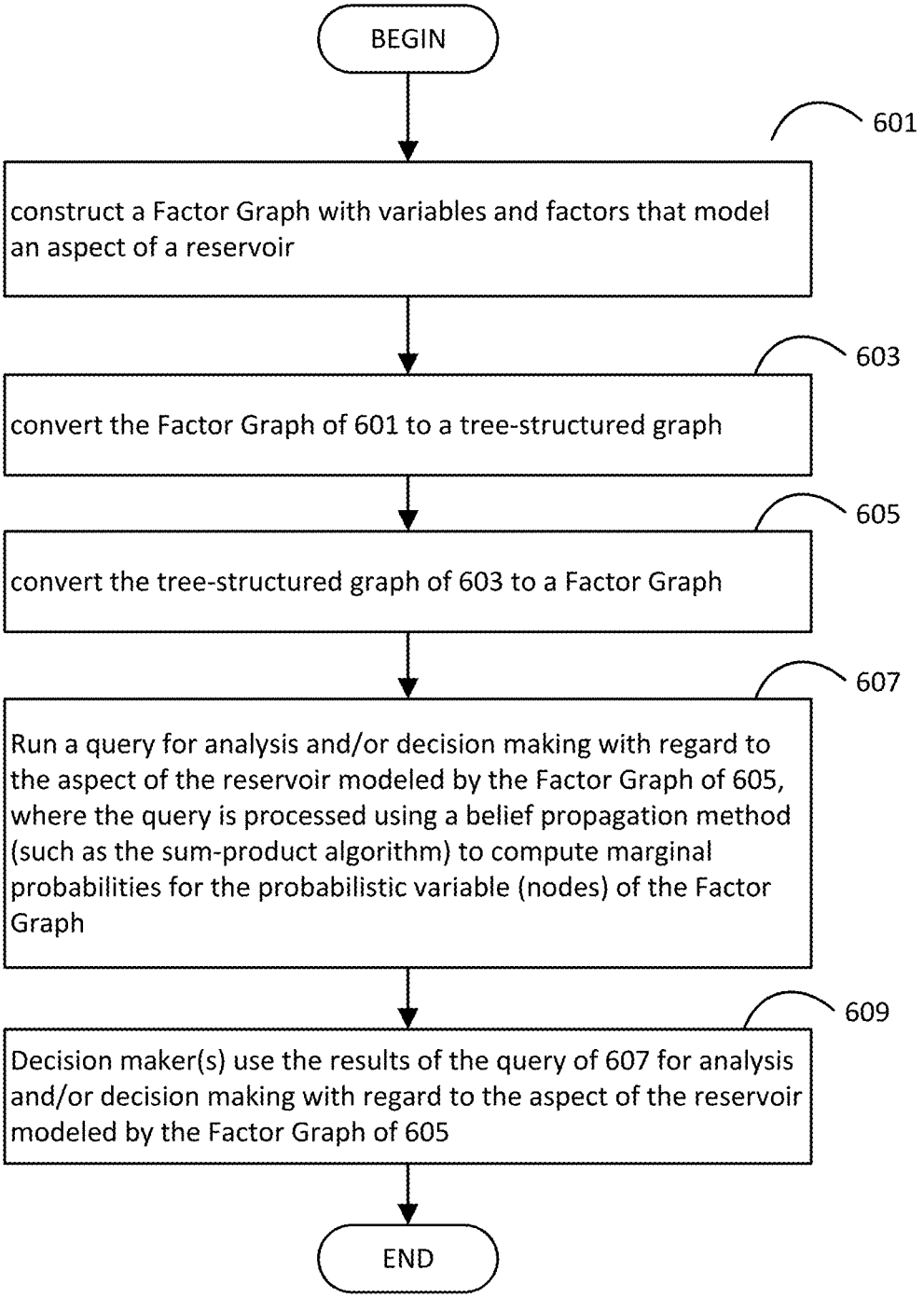
FIG. 6 is a flow chart illustrating a probabilistic inference workflow for constructing and processing a Factor Graph that models an aspect of a hydrocarbon-containing reservoir.

FIG. 6 illustrates an example computational framework for processing a Factor Graph that models (describes) an aspect of a hydrocarbon-containing reservoir of interest, which begins in block 601 where a Factor Graph is constructed with variables and factors that describe an aspect of a hydrocarbon-containing reservoir of interest. A subset of the variables of the Factor Graph of block 601 can be probabilistic in nature. Each such probabilistic variable can be defined by an associated probability density function or other conditional probability data.

In block 603, the Factor Graph of block 601 is converted to a tree-structured graph which does not contain any cycles or loops. In this conversion, each variable in the Factor Graph of block 601 becomes an element (such as a clique or sub-graph) in the tree-structured graph.

In block 605, the tree-structured graph of block 603 is converted to a Factor Graph which does not contain any cycles or loops. In this conversion, the probabilistic variables remain unchanged with the addition of factors representing the factorization of the graph. The lack of cycles or loops in the Factor Graph of block 605 allows many problems to be solved efficiently with a message-passing algorithm. These problems include the computation of the marginal distribution p(x) of a single variable or the joint distribution of several variables, or the computation of random samples x from a distribution p(x).

In block 607, a query is run for analysis and/or decision making with respect to aspect of the reservoir modeled by the Factor Graph of block 605. The query is processed using message passing (such as a the sum-product algorithm) for belief network propagation and probabilistic inference on the Factor Graph. Such inference can involve the computation of the marginal distribution p(x) of a single variable or the joint distribution of several variables, and drawing random samples x from a distribution p(x) with respect to the probabilistic variables of the Factor Graph of block 605. The query of block 607 can be one of several types, such as a probability of evidence query, a marginalization query, a maximum posterior hypothesis query, and a most probable explanation query. Multiple queries can be run as part of a sensitivity analysis or analysis that compares hypotheses.

In block 609, the results of the query of block 607 can be output (for example, visually displayed on a display screen or on a plot) for communication to one or more decision maker(s) and used for analysis and/or decision making with regard to the aspect of the reservoir modeled by the Factor Graph of 605. The results can include (or are based on) the uncertainty represented by the outcome of the probabilistic inference on the Factor Graph inference that is performed in block 607. This allows the decision maker(s) to take into account and understand the uncertainty within the aspect of the reservoir modeled by the computational framework.

FIG. 7 is a flow chart that illustrates example processes for constructing a Factor Graph that models an aspect of a reservoir (block 601). It is noted that the processes are iterative. Thus, as understanding of the reservoir system improves, the variables, structure and factors become more refined and the network learning improves.

The processes begin in block 701 where domain knowledge (such as the knowledge of scientist(s), engineer(s), and/or economist(s) that have a good idea how the reservoir functions) is used to define the variables that represent an aspect of a reservoir. This is generally done first but can be iteratively improved in the context of defining the causal structure and factors associated with the variables. One or more the variables can be probabilistic in nature and associated with initial probability data (such as an initial probability distribution function or CPT).

The variables can be continuous, discrete, categorical, or binary. Continuous variables can be real numbers (e.g., $-\infty<R<\infty$), signed real numbers (e.g., $0<R<\infty$), or bounded real numbers (e.g., $0\leq R\leq 1$). An example of continuous variable defined by a real or signed real number might be a measurement, while a compositional property (such as porosity) might be represented by continuos variable defined by a bounded real number. Discrete variables may be integral or natural numbers. An example would be the number of heads in a series of coin tosses. Categorical variables are represented by a finite set of states. For example, a rock type may have one of the following states: sandstone, shale, limestone, dolostone, etc. Binary variables have two states: true or false. Binary variables can be used to make simplifying assumptions that become part of the Factor Graph and the resulting reasoning framework.

For categorical and binary variables, the discrete states are defined from information that is critical to the variable. They are not to describe the spectrum of values the variable can assume, but the critical values. Thus, the states High, Medium and Low may not be crucial for the reasoning framework, but rather High and Low with a critical value signifying the boundary between the two (now binary) states. In can be useful to strive to have as few states in a variable as possible. It is generally useful to introduce additional variables than have multiple states on a single variable. When defining the discrete states for the categorical and binary variables, the following should be considered:

- what is the current state of the variable;
- to what state will the variable potentially change;
- are there any substantial intermediate states;
- states are compatible with the parent and child variables;
- the modeled states support all possible states the defined variable can assume; and
- when populating the probability data for probabilistic variables, the state definitions are precise, e.g., good might mean a value >0.005.

The Factor Graph can be configured to model one or more points in time-related causal phenomena. In this case, the following are considered with respect to time when designing the Factor Graph:

- feedback mechanisms; for example, the velocity of an object is a function of the velocity and position in a prior time; when designing variables and factors, this needs to be taken into account;
- long term vs. short term, e.g., short-term leak risk may be low, but long-term risk may be high; and
- when designing variables, it can be useful to clearly specify the temporal context if it is potentially ambiguous.

Figure 12:
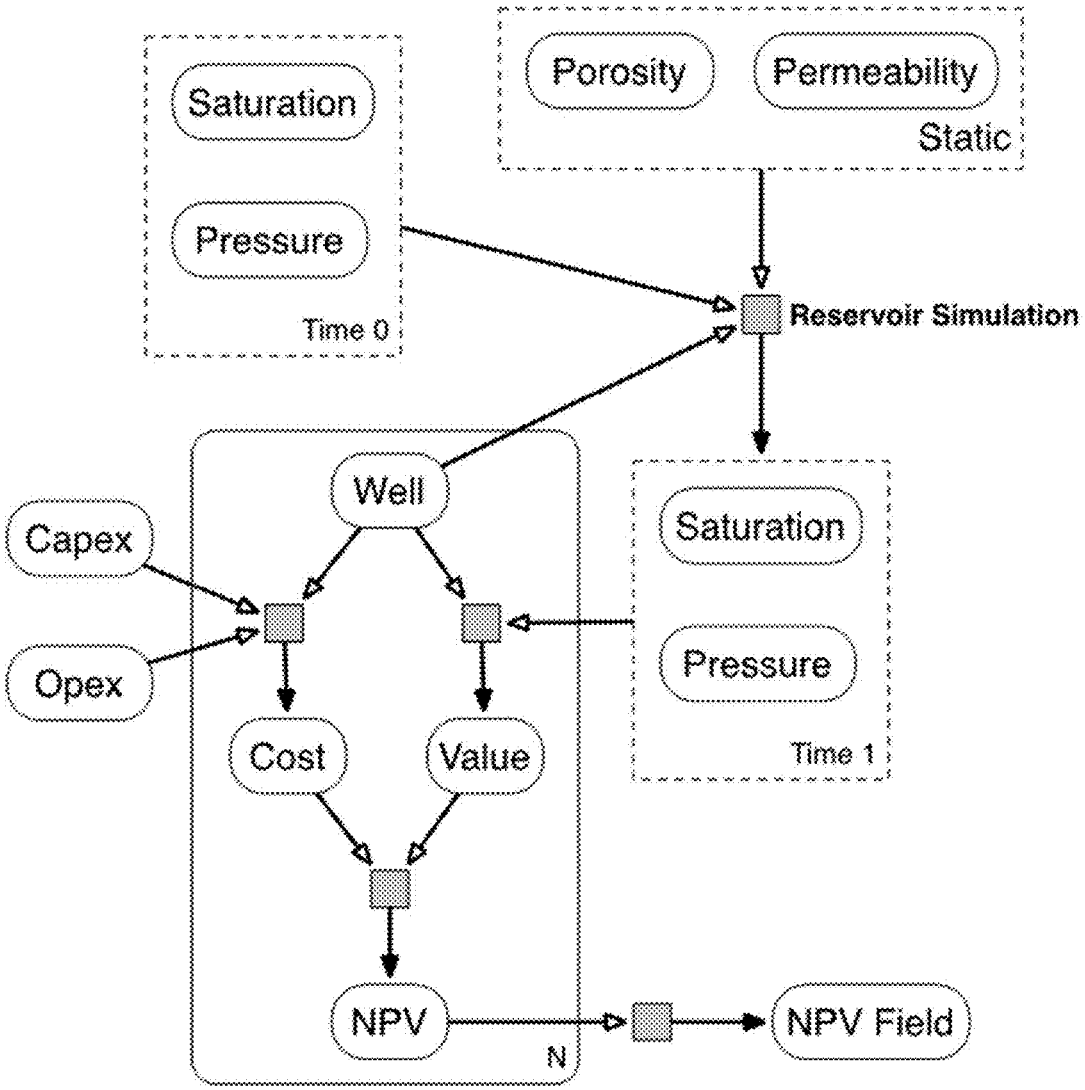
FIG. 12 shows an example of a Factor Graph that can be used for probabilistic reservoir simulation.

For example, FIG. 12 is a simplified Factor Graph illustrating probabilistic reservoir simulation. The variables Porosity and Permeability are considered static here in that they don't change over the time interval under study. On the other hand, the variables Saturation and Pressure do change over time. Time 0 can be used to represent the initial conditions of the Saturation and Pressure variables at the start of analysis, while Time 1 would represent the Saturation and Pressure variables after the specified time interval, e.g., 30 years of production.

Similar to time, the scale of the variable is to be precisely defined. For example, when defining variables that relate to an entire cementing job that may represent a depth interval of 10's to 100's of meters, the variables and states can be related to observations that might be made at a fine depth resolution, e.g., 1 cm. Thus, the probabilistic variable describing a phenomenon affecting the entire zone will be the summary variable of a probabilistic sub-graph that integrates the fine scale measurements over the entire interval. Thus, it would be meaningless to have a variable stating that fractures are present, but rather the variable would specify the depth interval fractured and conversely the un-fractured or coherent interval.

When defining the variables subject to the constraints above, it can be useful to classify variables as follows:

- Objective Variables: the variables to be affected. For example, minimizing the effective permeable path in a well casing.
- Intervention Variables: the variables that represent actions to be taken. For example, the type of cement used.
- Intermediate Variables: the variables that link interventions and objectives. For example, the distribution of cement in the borehole annulus.
- Control Variables: the variables that cannot be changed but are part of the system. For example, the diameter of the borehole, or porosity of the surrounding formation.
- Implementation Variables: the variables that constrain the type of intervention. Is the mud used oil based or water based.
- Additional Input Variables: the variables that are changed as a result of an intervention. For example, the depth to top of cement.
- Measurement Variables: the variables that represent observations of controlling factors and additional Impacts. For example, acoustic measurement of the cement bond to casing.

When a probabilistic variable has been defined, it is useful to understand if possible the prior probabilistic model describing the variable. For example, a continuous real variable may well be described with a single Gaussian or mixture model Gaussian. A compositional variable such as porosity may be described, for example, with a single Beta or mixture model Beta. For a discrete variable with multiple states, it might be useful to describe it with a Dirichlet distribution as described in chapter 9.4.3 of Barber, D., "Bayesian Reasoning and Machine Learning," 1st ed., Cambridge University Press, 2012, herein incorporated by reference in its entirety. Note that the selection of the appropriate model for a variables probability distribution is useful as it can help the efficiency of training and solving the overall network. If, in the network, conditioning and conditioned variables have conjugate models, then the message passing inference can solved analytically rather than with a more expensive numerical sampling approach.

The process then continues to block 703 where the causal relationships between variables are identified. In some examples, a set of five idioms as defined by Neil et al., "Building Large-Scale Bayesian Networks." The Knowledge Engineering Review 15, 1999, pgs. 257-284, can be used to represent the causal relationships between variables. These five idioms include:

- Definitional: combination of variables into a single variable.
- Cause-consequence: causal relationships
- Measurement: uncertainty associated with an observation or measurement
- Induction: inductive reasoning from similar variables Reconciliation: reconciliation of results from competing or complementary variables These idioms are akin to design patterns in software architecture and lend themselves to reusability. Recognizing these different idioms in the reservoir system enables a consistent and extensible design.

The process then continues to block 705 where the factors that connect the conditioning (parent) variables and conditioned (child) variables are identified. Note that such factors can take the form of logical gates (AND gates, OR gates), conditional probability tables (CPTs), or forward modeling simulators. Specifically, the factor can be implemented as

- a logical gate if the input and output parameters are Boolean variables; for example, an AND gate or OR gate.
- a conditional probability table (CPT); a CPT is useful when the input conditional and conditioned parameters are discrete.
- a probabilistic function such as a Gaussian distribution or a more complex mixture model.

Figure 7A:
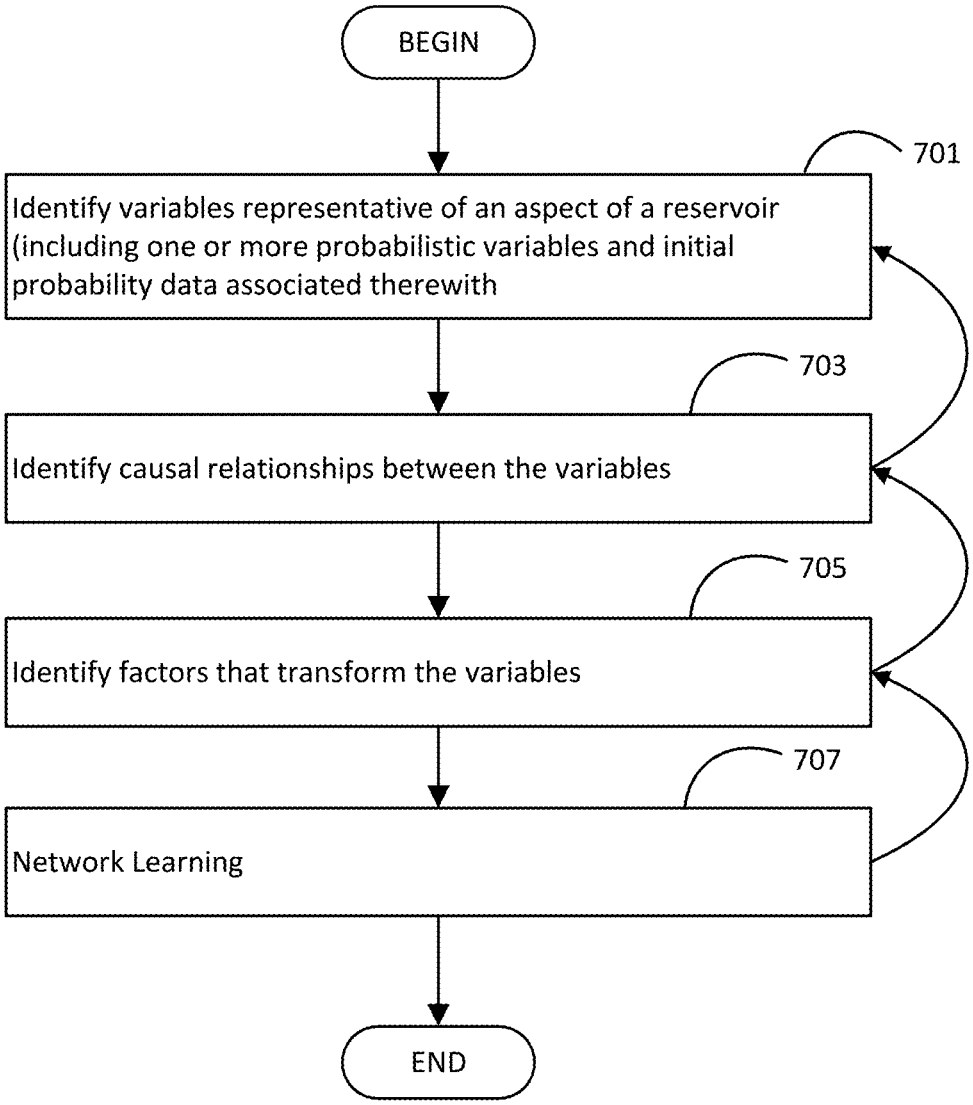
FIG. 7A is a flow chart illustrating operations for constructing a Factor Graph that models an aspect of a hydrocarbon-containing reservoir.
Figure 7B:
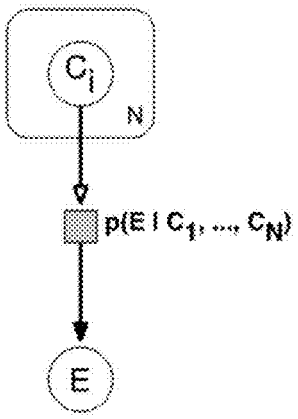
FIG. 7B illustrates a probabilistic factor of a Factor Graph.

FIG. 7B illustrates a factor Graph with N causal variables $C_i$ influencing variable E through a probabilistic factor. For variables with discrete states, probabilistic factor could be implemented as Conditional Probability Table (CPT). For continuous variables, the probabilistic factor would be implemented as a function or forward modeling simulator.

Figure 7C:
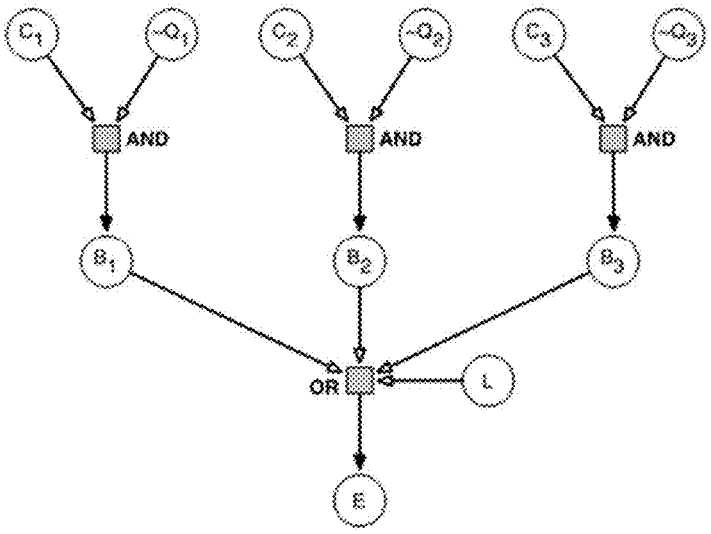
FIGS. 7C and 7D illustrate Noisy OR gates that can realize part of a Factor Graph.
Figure 7D:
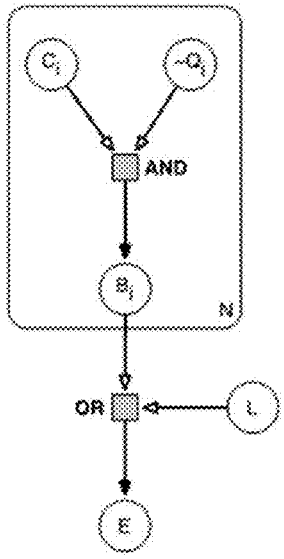

In some examples, a factor can be realized by a Noisy OR gate if the input and output parameters are Boolean variables. Examples of Noisy OR gates are shown in FIGS. 7C and 7D. In this case, each input causal variable $C_i$ has an associated suppression variable $Q_i$. The suppression variable $Q_i$ represents the probability the input causal variable $C_i$, when acting (true), does not cause the effect E. The AND factor of the Noisy OR gate results in $B_i$ being true iff $C_i$ is true and the suppression variable $Q_i$ is false. Then, the OR factor of the Noisy OR gate will yield a true value for E if any of $B_i$ is true. Noise is added to this model via the leak variable L. The leak variable typically has a very low probability and represents the probability that a phenomenon other than $C_i$ could yield a true value for E.

The Noisy OR gate can be used to reduce the number of conditional variables upon which a conditioned variable depends. Consider a simple network with one binary variable E (effect) conditioned on N causal variables $C_i$ (cause) with binary states as illustrated in FIG. 7D. For this simple network, the probabilistic factor could be implemented as a CPT with 2N rows reflecting the state permutations. If N is, for example, 8, then the CPT will have 256 rows. Populating this CPT algorithmically is straightforward, but if the probabilities in the CPT are elicited from experts, then the architecture is unacceptable. With the Noisy OR gate approach, the total number of probabilities that are to be elicited from the experts is now N+1=9. That is, the user would answer 8 questions of the form "If $C_i$ is true, then what is the probability that $C_i$ is NOT contributing to E?" There would also be one question related to leak variable of the form "What is the probability that E is caused by a phenomenon not considered?". Even for the relatively complex example described here, it is much more reasonable for an expert to answer 9 questions, than to answer 256 to populate the original CPT.

It is also contemplated that the Factor Graph can employ plates that are used to represent repeated instances of the sub-graph. An example of a plate is illustrated in FIG. 7D. The plate is represented as a rectangle with rounded corners, with the number of occurrences of the sub-graph indicated in the corner. In this figure, the sub-graph of the plate is repeated N times.

Figure 7E:
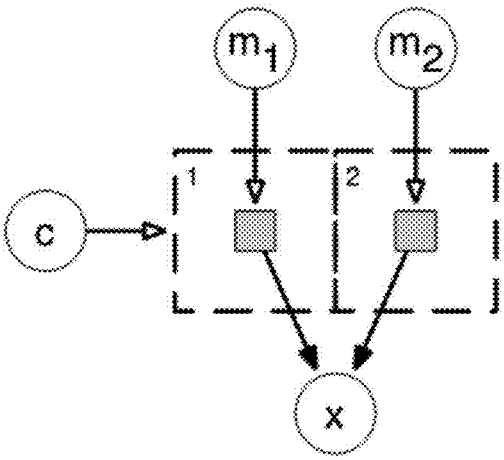
FIG. 7E illustrates a gate that can realize part of a Factor Graph.

It is also contemplated that the Factor Graph can employ gates that allow support for categorical variables, mixture models, and interventions. FIG. 7E is a simple example of gates extending the behavior of a basic Factor Graph. The gate is represented by a rectangle with dashed perimeter. The joint probability distribution corresponding to the gated Factor Graph in FIG. 7E is:

$$p(x,c,m_1,m_2)=p(c)p(m_1)p(m_2)p(x|m_1)^{\delta(c=1)}p(x|m_2)^{\delta(c=2)} \tag{2}$$

In this example, the variable c is a categorical variable that may assume the values 1 or 2. If c has the value 1, then the indicated gate is turned on, while the gate for category 2 is turned off. Conversely, if c has the value 2, then gate 2 is turned on and gate 1 is turned off. This switching behavior is implemented in the factorized probability function above, by exponentiation of the corresponding factor with the Kronecker delta function (δ). Thus, in the above equation, the following holds:

$$c=1\rightarrow p(x|m_1)^{\delta(c=1)}p(x|m_2)^{\delta(c=2)}=p(x|m_1)$$

$$c=2\rightarrow p(x|m_1)^{\delta(c=1)}p(x|m_2)^{\delta(c=2)}=p(x|m_2) \tag{3}$$

Note that c could assume a value of 1 or 2 based on an observation of the system, or it could represent a decision that is made, or it could be probabilistic in which case Eqn. (2) is a mixture model when the joint probability is marginalized over c.

Figure 7F:
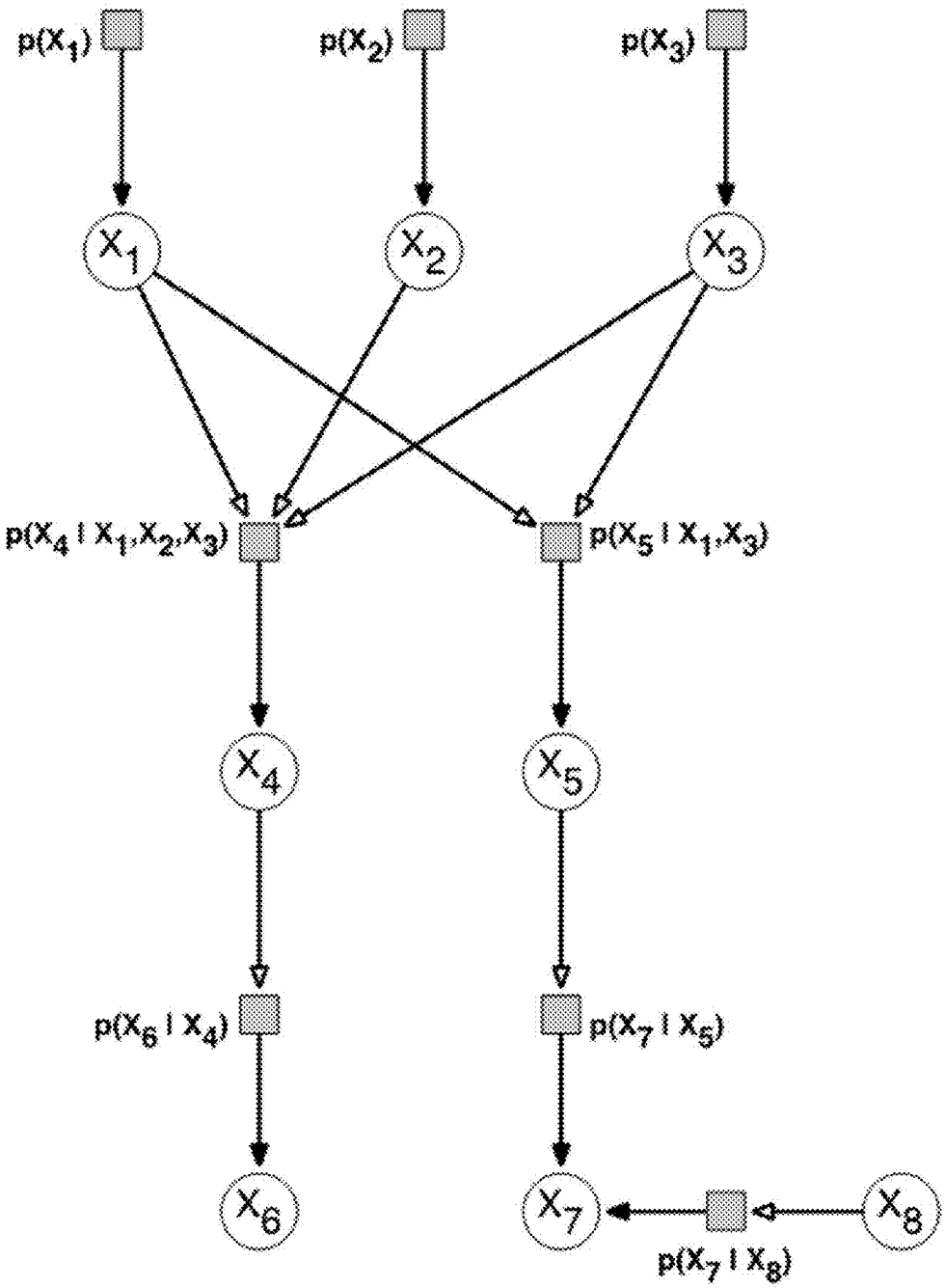
FIG. 7F illustrates an example Factor Graph that includes a noise variable X8.

It is also contemplated that the Factor Graph can employ noise variables that represent uncertainty with regard to a measured variable. It is commonly the case that when observed, a variable may not be precisely known. That is, the measurement may have uncertainty. When the uncertainty on an observation or measurement is large, then this evidence is commonly called "soft evidence". FIG. 7F is an example of a Factor Graph that employs a noise variable X8. Here, the noise variable X8 represents the precision (reciprocal of variance) of the measurement variable X7. The factor could then be a Gaussian with 0 mean and a precision defined by the variable X8.

Figure 7G:
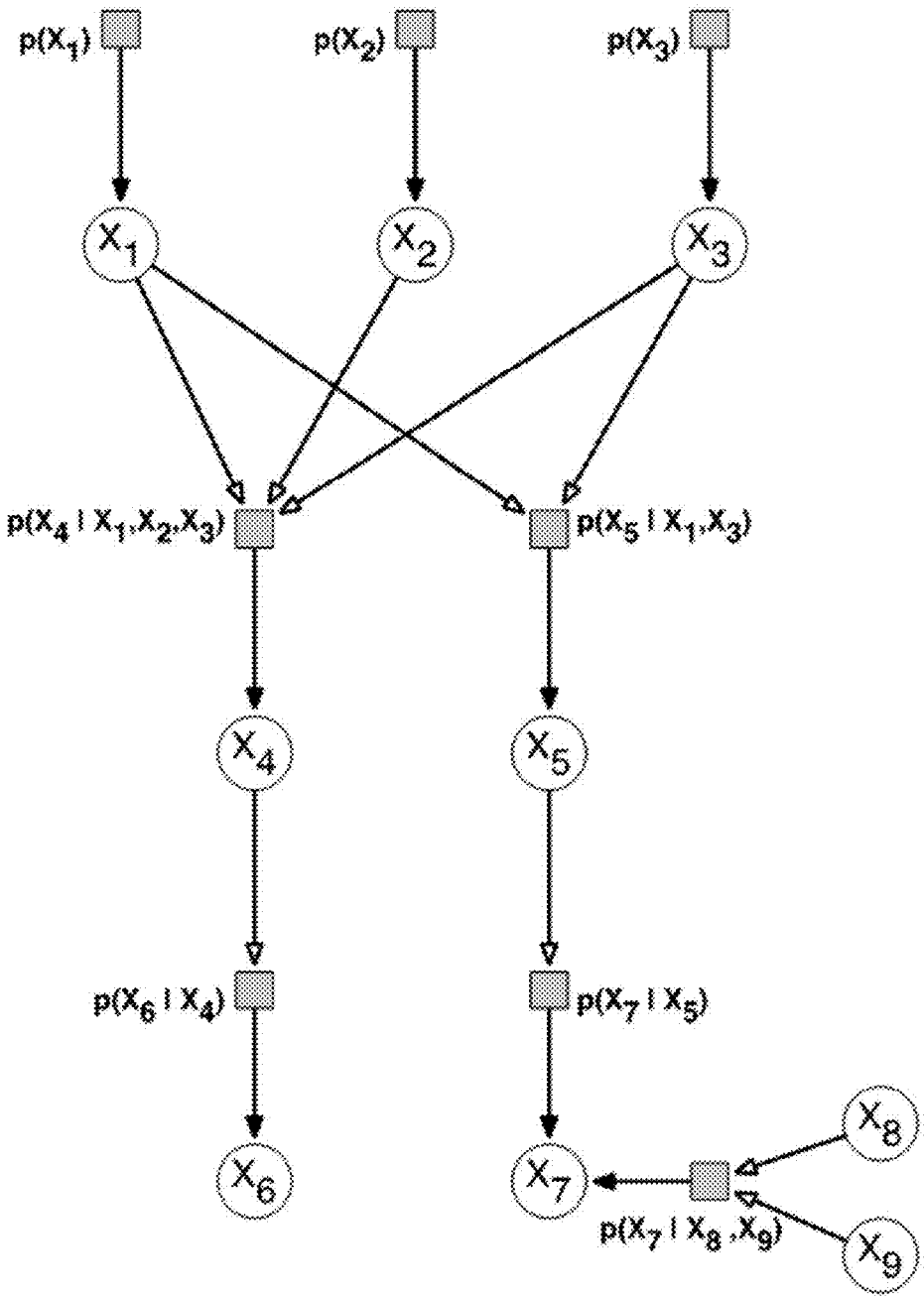
FIG. 7G illustrates an example Factor Graph that includes a variable X9 that represents the accuracy or trueness of the variable X7.

It is also contemplated that the Factor Graph can employ variables that represent accuracy or trueness with regard to a measured variable. Here, accuracy or trueness is defined as the probability the measurement agrees with the "true" value. For example, if the "true" porosity of a measurement were 0.30, then a number of measurements (e.g., 0.28, 0.30, 0.32) in which the mean value is 0.30 would have a high accuracy. In contrast, if a sequence of measurements yielded a mean value different from 0.30 then the measurement's accuracy would be low, e.g., 0.30, 0.32, 0.34, 0.36 (mean value of 0.33.) FIG. 7G is an example of a Factor Graph that employs the variable X9 to represent the trueness of X7. Here, the noise variable X8 represents the precision (reciprocal of variance) of the measurement variable X7. The factor could then be a Gaussian with mean X7+X9 and precision X8. In this case X9 would behave like the measurement bias.

When the factor is a probabilistic function, it can afford the opportunity to integrate a forward modeling application that may be as simple or as complex as needed. For example, consider the following deterministic model with additive noise ε:

$$y=f(\alpha,x)+\varepsilon, \tag{4}$$

where x is the independent observed data, and y the dependent variable with model parameter vector $\alpha$ and Gaussian noise $\varepsilon$ with mean 0 and precision (inverse variance) $\beta$.

In this case, the factor $p(y|\alpha,\beta,x)$ can be implemented as a normal distribution with mean $f(\alpha,x)$ and variance $\beta^{-1}$ as follows:

$$p(y|\alpha,\beta,x)=N(f(\alpha,x),\beta^{-1}). \quad (5)$$

Note that the actual behavior of the factor is independent of the design. Thus, the causal relationship between a set of variables and the effect is independent of how the factor relates them. An early implementation of the Factor Graph might implement the factor as a CPT trained from observed data, but a later implementation may utilize a forward model for the factor once understanding of the system improves. This is a powerful aspect of the Factor Graph approach in that the system model can be decoupled from the inference solution.

The process then continues to block 707 where network learning is carried out to define the behavior of the factors. If the factors are CPTs, then they are to be populated. There are a number of different sources of information for the network learning in the context of the reservoir system including but not limited to the following:

Type 1 information: raw data collected by direct measurement;

Type 2 information: raw data collected by stakeholder elicitation;

Type 3 information: output from process-based models and simulators; and

Type 4 information: academic "expert" opinion based on theory or calculation.

Some general guidelines outlined by Cain, "Planning Improvements in Natural Resources Management," Vol. 44, Centre for Ecology & Hydrology, 2001, herein incorporated by reference in its entirety, can be considered when using these different sources of information. Specifically, Type 1 information is generally better than Type 3 information, and Type 2 information is generally better than Type 4 information. Information Types 2 and 4 can involve elicitation. The results of elicitation can yield an Elicitation Probability Table (EPT) which can be used to generate the CPT. An EPT is designed explicitly for the elicitation process to minimize the number of probabilities that are to be elicited from stakeholders. Information types 2 and 4 are subjective but the following guidelines are useful. Elicited EPTs can be averaged across a group to derive a single EPT. The average could also be weighted by the expertise of the expert.

Figure 8A:
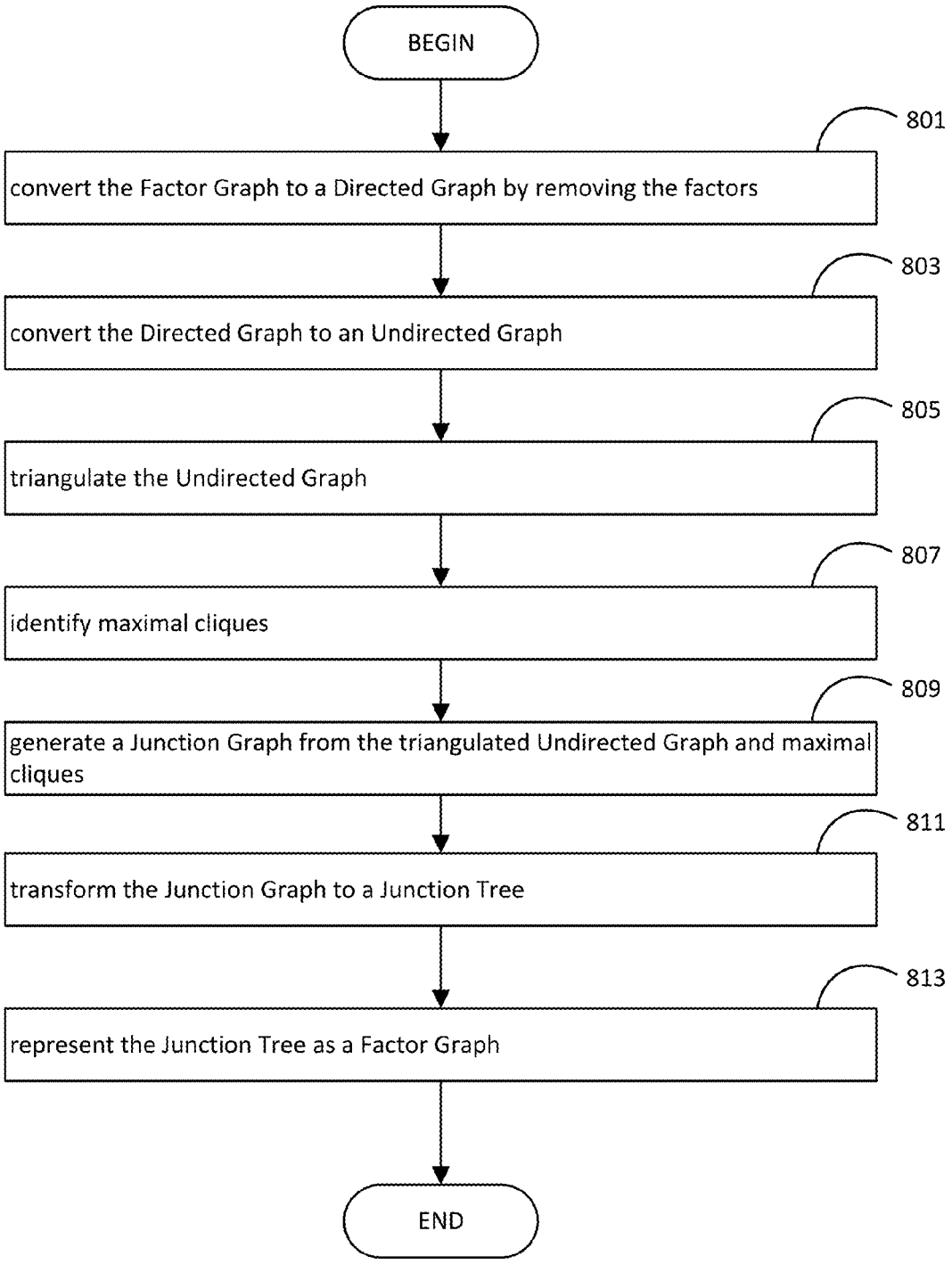
FIG. 8A is a flow chart illustrating operations that convert a Factor Graph to a Junction Tree and that convert the resultant Junction Tree to a Factor Graph without cycles.

FIG. 8A is a flow chart that illustrates example computational operations for converting a Factor Graph to a tree-structured graph which does not contain any cycle or loops (block 603) and then converting the resulting tree-structured graph to a Factor Graph that does not contain any cycles or loops (block 605). The computational operations begin in block 801 where the Factor Graph is converted to a Directed Graph by removing the factors. In the context, the Directed Graph is a graph in which the edges have direction associated with them. Further, the factors are removed and the edges are connected between the conditioning (parent) and conditioned (child) variables. This operation is illustrated in graphically in FIGS. 8B(i) and 8B(ii). FIG. 8B(i) shows the Factor Graph. FIG. 8B(ii) shows the Directed Graph formed by removing the factors from the Factor Graph of FIG. 8B(i).

The operations continue to block 803 where the Directed Graph is converted to an Undirected Graph through moralization. In an Undirected Graph, the edges do not have a direction. Moralization involves connecting all common parents of a variable. In a Directed Graph, two parents (conditioning variables) are associated because they have a common child (conditioned variable). In the Undirected Graph, this association between parents is retained by directly connecting them with each other. This operation is illustrated graphically in FIG. 8B(iii), which shows the Undirected Graph formed from the Directed Graph of FIG. 8B(ii).

The operations continue to block 805 to triangulate the Undirected Graph resulting from 803. Triangulation involves every cycle of 4 or more vertices to have a chord. This operation is illustrated graphically in FIG. 8B(iv) for the Undirected Graph of FIG. 8B(iii).

The operations then continue to block 807 to identify maximal cliques in the triangulated Undirected Graph that results from 805. A clique is a sub-graph in which every vertex in the sub-graph is directly connected to the other vertices. A maximal clique is a clique that cannot be extended by adding an adjacent vertex to the clique. For the triangulated Undirected Graph of FIG. 8B(iv), the maximal cliques are <A,B,C,D>, <B,C,D,F>, <E,F,H> and <F,G,I>.

The operations then continue to block 809 to generate a Junction Graph from the triangulated Undirected Graph that results from 805 and the maximal cliques identified in 807. The Junction Graph is formed with connecting separator nodes between the maximal cliques satisfying the running junction property, which states that the separator node on a path between maximal cliques u and v contain the intersection of maximal cliques u and v. This operation is illustrated in Junction Graph of FIG. 8B(v) that is formed from the triangulated Undirected Graph of FIG. 8B(iv) and the maximal cliques <A,B,C,D>, <B,C,D,F>, <E,F,H> and <F,G,I> for the triangulated Undirected Graph of FIG. 8B(iv).

The operations continue to block 811 where the Junction Graph resulting from 809 is transformed into a Junction Tree. The Junction Tree is an undirected tree-structured graph in which any two vertices are connected by exactly one path and thus does not contain any cycles or loops. This can be accomplished by breaking any cycles on the Junction Graph that have the same separator nodes through removing one of the separator nodes. This operation is illustrated in Junction Graph of FIG. 8B(vi) where the separator node F between nodes <E,F,H> and <F,G,H> is removed.

Finally, the operations continue to block 813 where the Junction Tree of block 811 is converted to a Factor Graph. In this operation, the nodes of the Junction Tree become variables of the resulting Factor Graph with a factor between associated nodes according to the factorization of the Junction Tree. This operation is illustrated in FIGS. 8C(i) and 8C(ii). FIG. 8C(i) shows the Junction Tree. FIG. 8C(ii) shows the Factor Graph formed from the Junction Tree of FIG. 8C(i). This Factor Graph now represents the factorization of the Junction Tree of FIG. 8C(i), viz. P(ABCD,BCD,BCDF,F,EFH,FGI)=P(ABC,BCD)P(BCD,BCDF)P(F)P(EFH)P(FGI). Note that the edges of the Factor Graph of FIG. 8C(ii) can be represented by directional arrows that represent the causal relationships in the model. These directional arrows are not shown here. Note the resulting Factor Graph is a tree does not contain any cycles or loops. Also note that the message passing operations performed on the Factor Graph of FIG. 8C(ii) are independent of these casual relations due to the fact that this Factor Graph is a tree that does not contain any cycles or loops. Also note that the two same separator nodes F can be combined to form a single variable node in the Factor Graph.

Once the Factor Graph of 811 is constructed, it is possible to use the Factor Graph for querying and probabilistic inference on the Factor Graph as well as decision-making with regard to the aspect of the reservoir that is modeled by the Factor Graph.

In one example, a probability of evidence query can be run on the Factor Graph which asks the probability of an observation or measurement given some control variables. Thus, if we know the values of some control variables $X_1$, $X_2$ and $X_3$ then we infer the marginal distribution of a Measurement variable, viz:

$$p(X_6,X_7|X_1,X_2,X_3). \tag{6}$$

In another example, a marginalization query can be run on the Factor Graph. Consider a joint probability distribution $$p(X_1, \ldots ,X_n). \tag{7}$$

In this case, the marginalization query can involve obtaining the joint probability distribution as follows:

$$p(X_1, \ldots , X_m) = \sum_{x_{m+1},\ldots,x_n} p(X_1, \ldots , X_n), \tag{8}$$

where m<n.

Note that this example is the prior marginal as no evidence is considered. If some variables have been observed resulting in evidence e, then the posterior marginal is defined as $$p(X_1, \ldots , X_m \mid e) = \sum_{x_{m+1},\ldots,x_n} p(X_1, \ldots , X_n \mid e). \tag{9}$$

In this example, the prior marginal for the control variables is given by:

$$p(X_1, X_2, X_3) = \sum_{x_4,x_5,x_6,x_7} p(X_1, X_2, X_3, X_4, X_5, X_6, X_7), \tag{10}$$

and the posterior marginal for the control variables given evidence $X_6$ and $X_7$ is given by:

$$p(X_1, X_2, X_3 \mid X_6, X_7) = \sum_{x_4,x_5} p(X_1, X_2, X_3, X_4, X_5 \mid X_6, X_7). \tag{11}$$

Thus, in this case, marginalization is used to estimate prior and posterior probabilities on a subset of the variables. It should be clear that probability of evidence is a special case of posterior marginalization.

In yet another example, the Factor Graph can be queried as part of a sensitivity analysis in order to understand the sensitivity of the variables of the model and possibly identify the most sensitive variables. Note that the Factor Graph is a powerful tool that allow robust propagation of evidence from uncertainties in parameters to uncertainties in outcomes. However, if interventions are proposed, it is sometimes challenging in a complex Factor Graph to determine the most sensitive variables. There has been a great deal of analysis in this area with regard to Probabilistic Networks and one of the most successful and robust approaches is Shannon's Mutual Information, which is expressed in Eqn. (12) below:

$$I(T, X) = -\sum_x \sum_t P(t, x)\log\frac{P(t, x)}{P(t)P(x)}, \tag{12}$$

where P(t) is the prior probability of a variable T before observing X,

P(x) is the probability of X, and

I(T,X) is then the total uncertainty reducing potential of observing X.

Shannon's Mutual Information criterion is a means of relating an observation or intervention X on the reduction in uncertainty of a parameter T. Each relevant variable X in the Factor Graph that is a candidate for observation or intervention may be tested for its uncertainty reducing potential on each variable T.

In still another example, the Factor Graph can be queried as part of analysis that compares different models or hypotheses. Consider Bayes' Theorem below where $$p(M_i \mid D) = \frac{p(D \mid M_i)p(M_i)}{p(D)}, \tag{13}$$

where D is the data we're trying to model, and $M_i$ is a model under consideration.

Then, two models $M_i$ and $M_j$ yield the following:

$$\frac{p(M_i \mid D)}{p(M_j \mid D)} = \frac{p(D \mid M_i)}{p(D \mid M_j)}\frac{p(M_i)}{p(M_j)}. \tag{14}$$

Figure 7H:
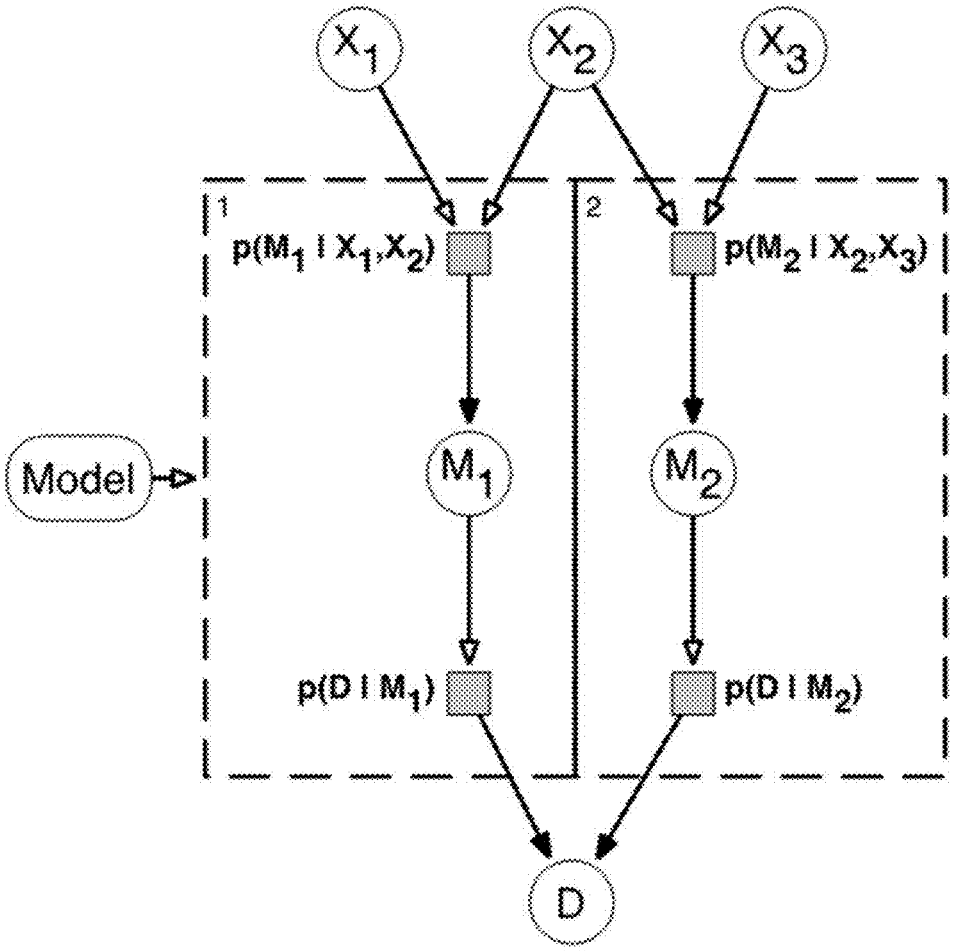
FIG. 7H illustrates a model selection gate that can realize part of a Factor Graph.

Note that the term $$\frac{p(D \mid M_i)}{p(D \mid M_j)}$$

is known as the Bayes' Factor and is generally expressed as odds of model $M_i$ to $M_j$. A Factor Graph is useful in expressing this model comparison. Note that model comparison can be injected into a Factor Graph so that multiple models/hypotheses can be considered at once and easily compared. This can be accomplished with a gate as shown in FIG. 7H with a control parameter "Model" that is used to switch between the two models $M_i$ to $M_2$ being evaluated.

In processing the query of the Factor Graph that models an aspect of the reservoir of interest, a belief propagation method (such as the Sum-Product algorithm) can be used to perform message passing operations that performs probabilistic inference on the Factor Graph. Such inference can involve the computation of the marginal distribution p(x) of a single variable or the joint distribution of several variables, and drawing random samples x from a distribution p(x) with respect to the probabilistic variables of the Factor Graph. In some examples, the sum-product algorithm can be used for belief propagation because it allows the probabilistic inference to be computed in an efficient manner by message passing.

For example, consider marginalizing variables $X_2, \ldots, X_7$ in Eqn. (1) above to obtain the marginal probability $p(X_1)$. The brute force approach (inefficient) would entail solving Eqn. (1) for every permutation of $X_2, \ldots, X_7$. If, for example, these variables were binary variables, this would involve computing Eqn. (1) 64 times ($2^6$ iterations). A network with 100 binary variables would have to be evaluated $6.338\times10^{29}$ times ($2^{99}$ iterations). In contrast, the sum-product algorithm allows the marginal distribution to be computed for each unobserved node, conditional on any observed nodes. This approach takes advantage of the structure and conditional dependencies between the variables.

On a Factor Graph, the joint probability mass can be expressed as:

$$p(x) = \prod_{a\in F} f_a(x_a), \tag{15}$$

where x is the vector of variables, and $x_a$ is the sub-vector of variables neighboring the factor a. The sum-product algorithm works by passing real-valued functions called messages from node to node in the Factor Graph. These messages carry the "influence" that one variable exerts on the other. These messages are computed differently, depending on whether the message is arriving at a variable or a factor node. Formally, the expressions for the messages are as follows.

The message from a variable node ν to a factor node a is computed as:

$$\forall\, x_v \in Dom(v), \tag{16}$$
$$\mu_{v\to a}(x_v) = \prod_{a^*\in N(v)\setminus\{a\}} \mu_{a^*\to v}(x_v).$$

And the message from a factor node a to a variable node ν is computed as:

$$\forall\, x_v \in Dom(v), \tag{17}$$
$$\mu_{a\to v}(x_v) = \sum_{x'_a:\ x'_v=x_v} f_a(x'_a) \prod_{v^*\in N(a)\setminus\{v\}} \mu_{v^*\to a}(x'_{v^*}).$$

Figure 9:
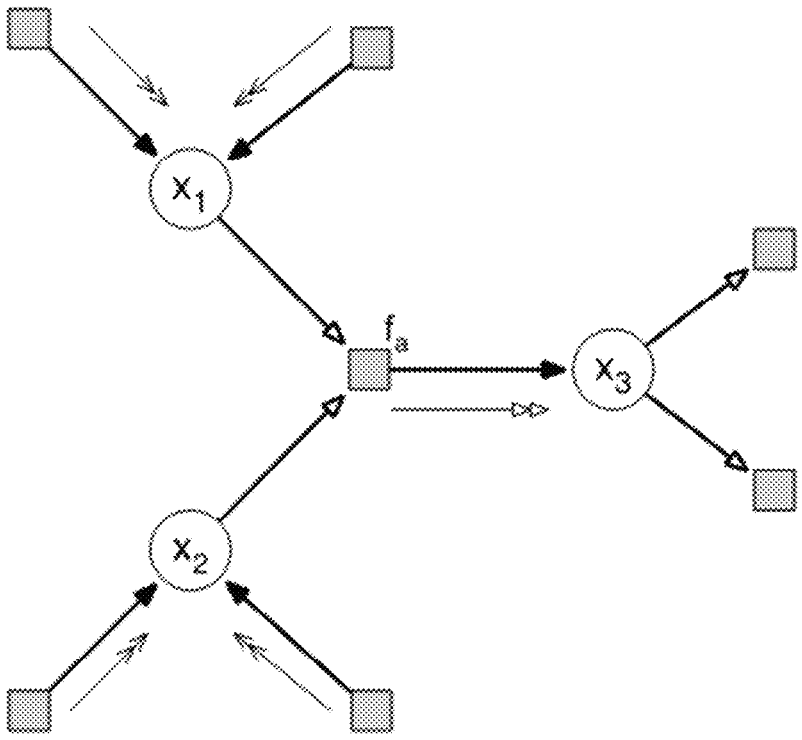
FIG. 9 illustrates example message passing operations carried out as part of the Sum-Product Algorithm on a Factor Graph without cycles.

In these computations, $\mu_{v\to a}$ is message from variable node ν to factor node a, $\mu_{a\to v}$ is the message from a factor node a to a variable node ν, $N(v)\setminus\{a\}$ is the set of factor nodes neighboring the variable node ν excluding the recipient factor a, and $N(a)\setminus\{v\}$ the set of variable nodes neighboring the factor node a excluding the recipient variable ν. Eqn. (17) shows that the entire marginalization of the Factor Graph can be reduced to a sum of products of simpler terms than the ones appearing in the full joint probability distribution expression. This is why it is called the Sum-Product algorithm, and schematically illustrated in FIG. 9. The Sum-Product Algorithm can be simply viewed as messages sent out from factors to variables. In this example, the outgoing message from factor node $f_a$ to variable node $x_3$ can be obtained by taking the product of all the incoming messages to variable nodes $x_1$ and $x_2$ (double headed arrows), multiply by the factor $f_a$, then marginalized over the variables $x_1$ and $x_2$. A more detailed description of the Sum-Product algorithm may be found in Bishop, C. M., "Pattern Recognition and Machine Learning," 1st ed., Springer, 2006, p. 738; and Pearl, J., "Probabilistic Reasoning in Intelligent Systems: Networks of Plausible Inference," 1st ed., Morgan Kaufmann, 1988, pg. 552; herein incorporated rated by reference in their entireties.

Note that the Sum-Product algorithm involves iterative message-passing. The messages are real valued variables in the probability space that are associated with the edges as described in Eqn. (17). Specifically, for each iteration $\mu_{v^*\to a}(x_{v^*}')\geq 0$ and $\Sigma\mu_{v^*\to a}(x_{v^*}')=1$. Messages are normally assigned an initial uniform distribution, i.e. each state is equiprobable. Messages are then propagated through the Factor Graph via Eqns. (16) and (17). One scheduling scheme can be described as follows, Before starting, the graph is orientated by designating one node as the root, and any non-root node which is connected to only one other node is called a leaf. In the first process, messages are passed inwards: starting at the leaves, each node passes a message along the (unique) edge towards the root node. The tree structure guarantees that it is possible to obtain messages from all other adjoining nodes before passing the message on. This continues until the root has obtained messages from all of its adjoining nodes. The second process involves passing the messages back out: starting at the root, messages are passed in the reverse direction. The algorithm converges and thus is completed when all leaves have received their messages. It has been shown that for tree-structures such as the resulting Factor Graph, convergence is exact and will occur after at most t* iterations, where t* is the diameter of the graph (the maximum distance between any two nodes). After completion, the left hand side of Eqn. (16) defines the marginal probability of the respective variable.

Note that the Factor Graph representation that is queried and processed with the Sum-Product algorithm does not contain any cycles or loops. This feature allows many problems can be solved efficiently by message passing with the Sum-Product algorithm. These problems include the computation of the marginal distribution p(x) of a single variable or the joint distribution of several variables, and drawing random samples x from a distribution p(x).

Figure 10A:
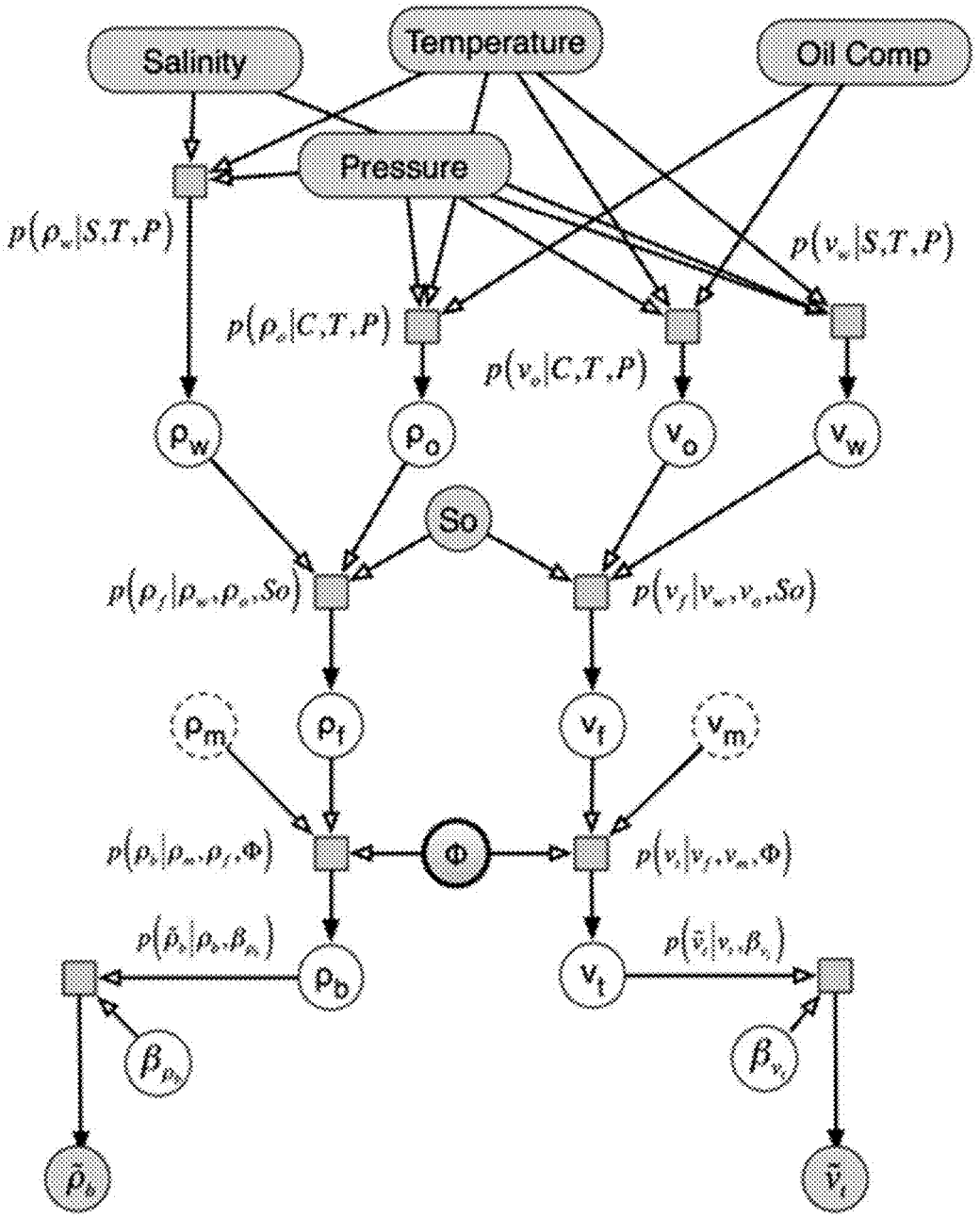
FIG. 10A illustrates an example Factor Graph that models multi-physics probabilistic subsurface (logging) measurements as related to a physical property (porosity) of the rock in a reservoir of interest.

FIG. 10A is an illustration of a Factor Graph that models multi-physics probabilistic subsurface (logging) measurements as related to a physical property (porosity) of the rock in a reservoir of interest. The first measurement variable ($\tilde{\rho}_b$) represents the measured bulk density of the reservoir rock with a precision ($\beta_{\rho_b}$) of the measurement. The measured bulk density of the reservoir rock $\tilde{\rho}_b$ is typically measured by a downhole logging tool. In this case, the precision ($\beta_{\rho_b}$) of the measurement can be dictated by the accuracy of the measurement carried out by the downhole logging tool. The variable $\rho_b$ is the actual or true bulk density of the rock. The conditioning variable $\rho_m$ is the actual or true density of mineral matrix, and the conditioning variable $\rho_f$ is the actual or true density of the fluid in the pores. The porosity φ of the reservoir rock can be related to these variables according to the following relationship:

$$\Phi = \frac{\rho_m - \rho_b}{\rho_m - \rho_f}. \tag{17}$$

Note that a factor represents an operator between the variable $\rho_b$ representing the actual or true bulk density of the rock and the measurement variable ($\tilde{\rho}_b$) representing the measured bulk density of the reservoir rock with the precision ($\beta_{\rho_b}$) of the measurement. This factor can possibly be implemented as a Gaussian distribution model as follows:

$$p(\tilde{\rho}_b|\rho_b,\beta_{\rho_b})=N(\rho_b,\beta_{\rho_b}^{-1}). \tag{18}$$

Note that precision of the measurement therefore causally affects the precision of the measured bulk density, and conversely the true or actual bulk density of the model.

The second measurement variable $\tilde{v}_t$ represents the measured acoustic velocity of the reservoir rock with a precision ($\beta_{v_t}$) of the measurement. The measured acoustic velocity of the reservoir rock $\tilde{v}_t$ is typically measured by a downhole logging tool or analysis of surface-acquired seismic data. In this case, the precision ($\beta_{\rho_b}$) of the measurement can be dictated by the accuracy of the measurement carried out by the downhole logging tool or the analysis. The variable $v_t$ represents the actual or true acoustic velocity of the reservoir rock, the conditioning variable $v_m$ represents the actual or true acoustic velocity of the mineral matrix of the reservoir rock, and the conditioning variable $v_f$ represents the actual or true acoustic velocity of the pore fluid of the reservoir rock. The porosity $\varphi$ of the reservoir rock can be related to these variables according to the following relationship:

$$\frac{1}{v_t} = \frac{1-\Phi}{v_m} + \frac{\Phi}{v_f}. \tag{19}$$

Note that a factor represents an operator between the variable $v_t$ representing the actual or true acoustic velocity of the reservoir and the measurement variable $\tilde{v}_t$ representing the measured acoustic velocity of the reservoir rock with the precision ($\beta_{v_t}$) of the measurement ($\tilde{\rho}_b$). This factor can possibly be implemented as a Gaussian distribution model as follows:

$$p(\tilde{v}_t|v_t,\beta_{v_t})=N(v_t,\beta_{v_t}^{-1}). \tag{20}$$

Note that precision of the measurement therefore causally affects the precision of the measured acoustic velocity, and conversely the true or actual acoustic velocity of the model.

The porosity $\varphi$ of the reservoir rock is the parameter of interest in this example and is derived from Eqns. (17) and (19). The Factor Graph of FIG. 10A illustrates how the bulk density ($\rho_b$) and the acoustic velocity ($v_t$) are causally dependent on the porosity ($\Phi$). It is this causal relationship that allows the two different measurements to be combined probabilistically. In this model, the factor computing bulk density $p(\rho_b|\rho_m,\rho_f,\Phi)$ evaluates the causal (or forward model) version of Eqn. (17) as follows:

$$\rho_b=\rho_m-\Phi(\rho_m-\rho_f). \tag{21}$$

Similarly, the factor computing bulk density $p(v_t|v_f,v_m,\Phi)$ evaluates the causal (or forward model) version of Eqn. (19) as follows:

$$v_t = \frac{v_m v_f}{v_f(1-\Phi)+v_m\Phi}. \tag{22}$$

Note that the conditioning variables $\rho_f$ and $v_f$ also have uncertainties depending on the source of the data.

This is illustrated for the fluid density $\rho_f$ in the upper left part of FIG. 10A and is defined by the factor:

$$p(\rho_f|\rho_w,\rho_o,So), \tag{23}$$

where $\rho_w$ is the water density, $\rho_o$ is the oil density, and $S_o$ is the oil saturation.

In this simple example, the reservoir conditions are undersaturated black oil above bubble point in which there are only the two phases of oil and water and the following causal (forward model) relationship holds:

$$\rho_f=\rho_w(1-So)+\rho_o So. \tag{24}$$

FIG. 10A also shows how the water density ($\rho_w$) and oil density ($\rho_o$) at reservoir conditions are conditionally dependent on the reservoir temperature and pressure, salinity, and the fluid compositions of the oil phase, which are typically measured by downhole logging tools. The salinity and fluid compositions of the oil phase can also be measured by laboratory analysis of formation fluid samples acquired from the reservoir.

This is also illustrated for the acoustic velocity of the pore fluid of the reservoir rock $v_f$ in the upper right part of FIG. 10A and is defined by the factor:

$$p(v_f|v_w,v_o,S_o), \tag{25}$$

where $v_w$ is the acoustic velocity of the water phase of the pore fluid of the reservoir rock, $v_o$ is the acoustic velocity of the oil phase of the pore fluid of the reservoir rock, and $S_o$ is the oil saturation.

FIG. 10A also shows how the acoustic velocities $v_w$, $v_o$ of the water and oil phases of the pore fluid of the reservoir rock at reservoir conditions are conditionally dependent on the reservoir temperature and pressure, salinity and the fluid compositions of the oil phase which are typically measured by downhole logging tools. The salinity and fluid compositions of the oil phase can also be measured by laboratory analysis of formation fluid samples acquired from the reservoir.

Figure 10B:
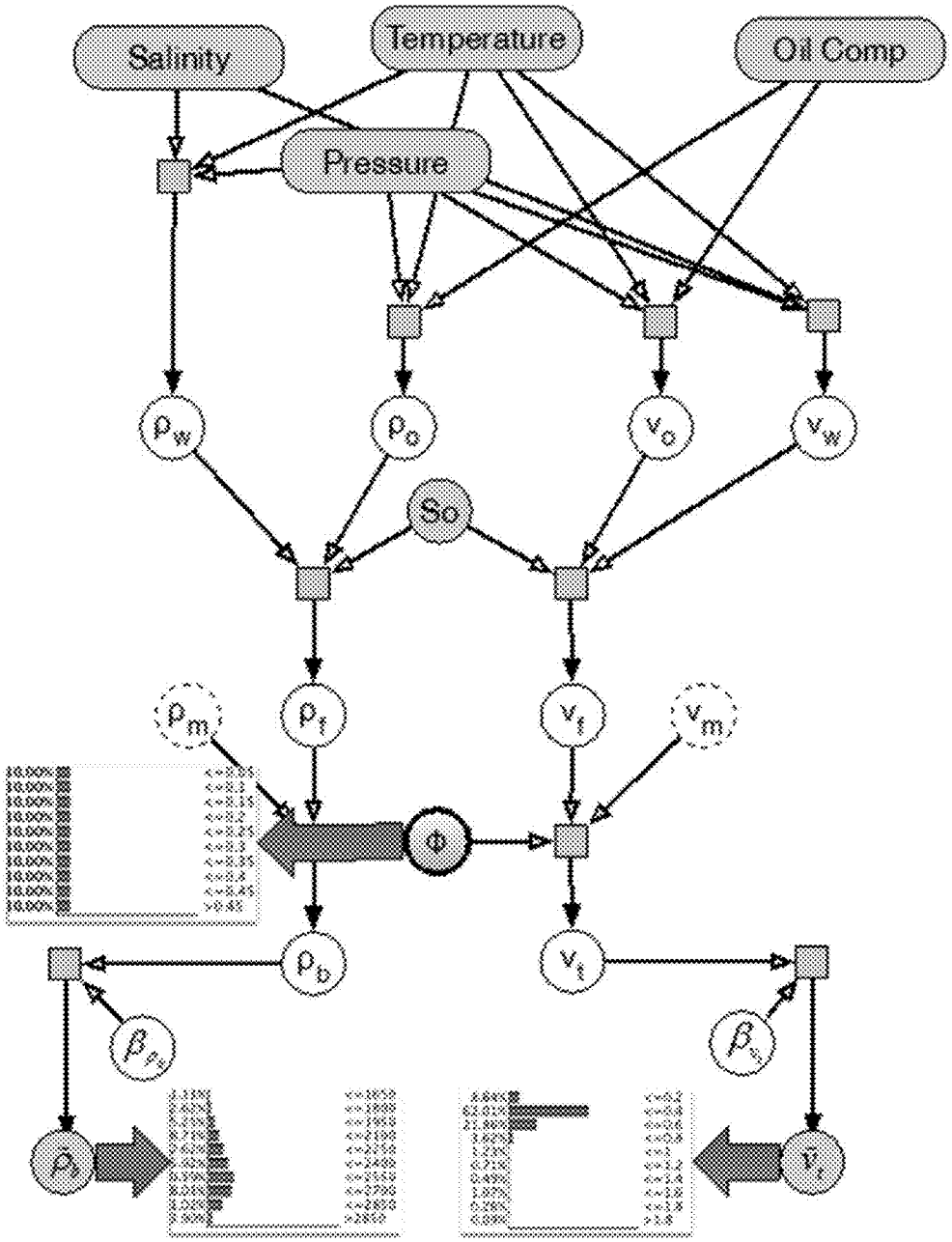
FIG. 10B shows example probability distribution functions that are initially associated with the measurement variables $\tilde{\rho}_b$ and $\tilde{\nu}_t$ and with the parameter of interest $\varphi$ of the Factor Graph of FIG. 10A.

FIG. 10B shows example probability distribution functions that are initially associated with the measurement variables $\tilde{\rho}_b$ and $\tilde{v}_t$ of the Factor Graph and with the parameter of interest $\varphi$. In this case, the measurements have not yet been made and the uncertainty distributions in the parameters represent the prior probabilities.

Figure 10C:
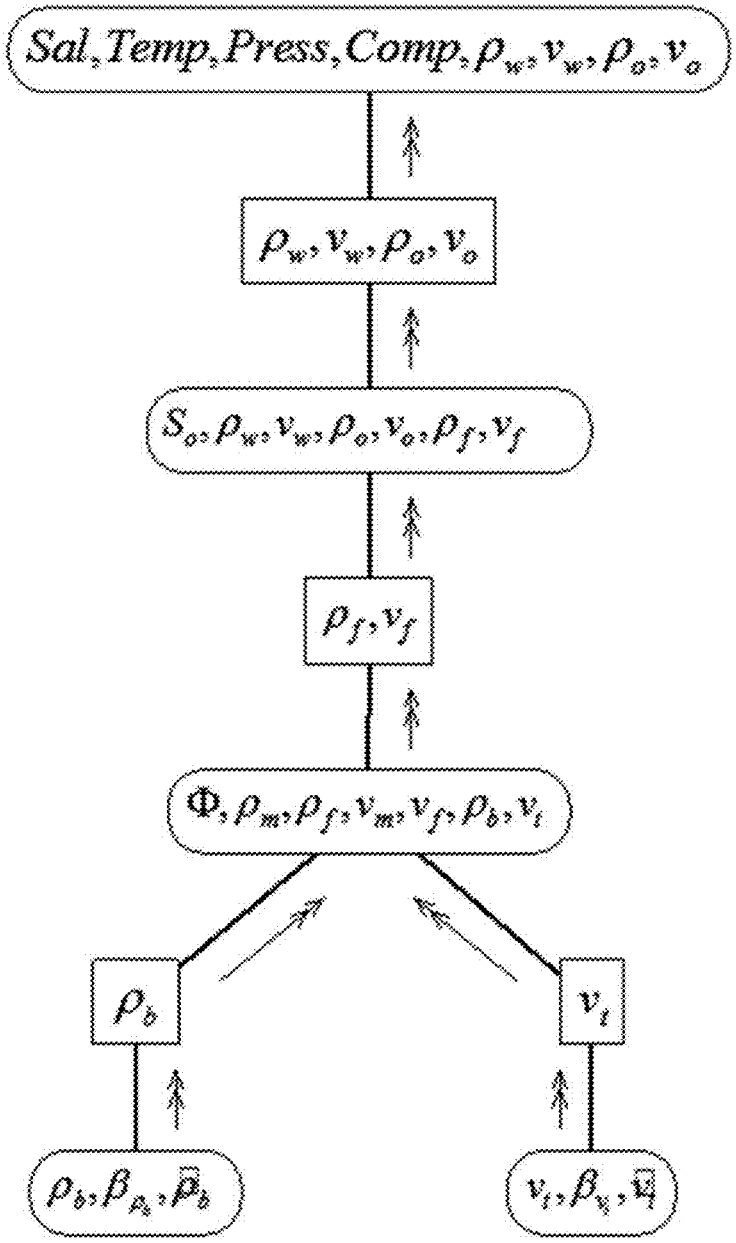
FIG. 10C illustrates an example Factor Graph without cycles as derived from the Factor Graph of FIG. 10A as well as the message passing operations carried out as part of the Sum-Product Algorithm on this Factor Graph.

FIG. 10C illustrates the tree-structured Factor Graph that is derived by transformation of the Factor Graph of FIG. 10A according to the computation operations of FIG. 8A. The Factor Graph representation of FIG. 10C can be processed with the Sum-Product algorithm as described previously. For example, the bulk density factor $p(\rho_b|\rho_m,\rho_f,\Phi)$ consumes messages from the conditioning variables $\rho_m,\rho_f,\Phi$ to generate messages describing their influence on the bulk density $\rho_b$. The message passing is illustrated by double-headed arrows in FIG. 10C.

Figure 10D:
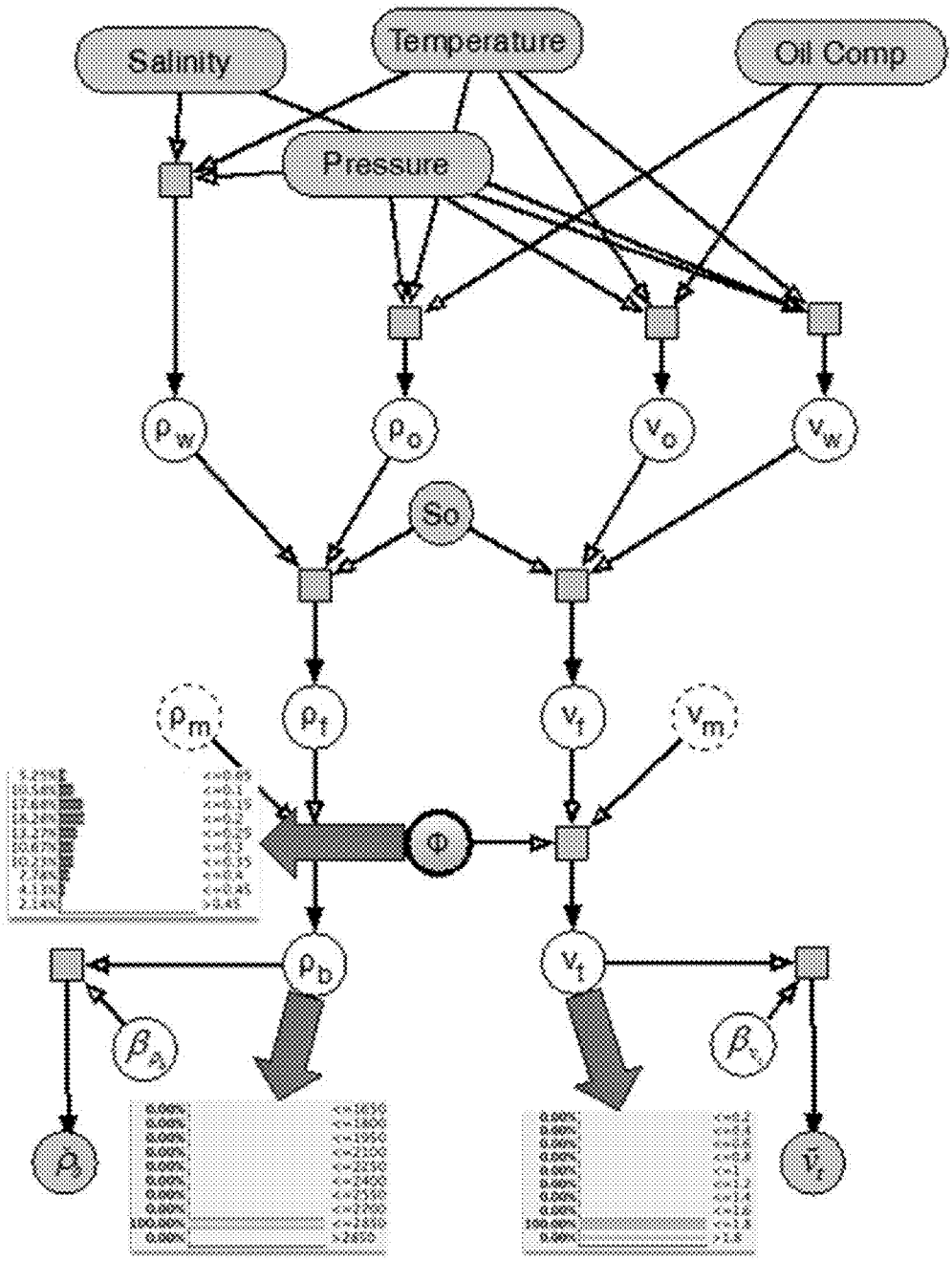
FIG. 10D shows example probability distribution functions that are associated with the measurement variables $\tilde{\rho}_b$ and $\tilde{\nu}_t$ and with the parameter of interest $\varphi$ of the Factor Graph of FIG. 10A after completion of the message-passing provided by the Sum-Product algorithm; in this case, the measurements have been made and the interpreted porosity is updated accordingly after measurement.

FIG. 10D shows example probability distribution functions that are associated with the measurement variables $\tilde{\rho}_b$ and $\tilde{v}_t$ of the Factor Graph and with the parameter of interest $\varphi$ after completion of the message-passing provided by the Sum-Product algorithm. In this case, the measurements have been made and the interpreted porosity is updated accordingly. One or more decision maker(s) can use the interpreted porosity for analysis and/or decision making with regard to the aspect of the reservoir modeled by the Factor Graph. This allows the decision maker(s) to take into account and understand the uncertainty within the porosity of the reservoir modeled by the computational framework.

Figure 11A:
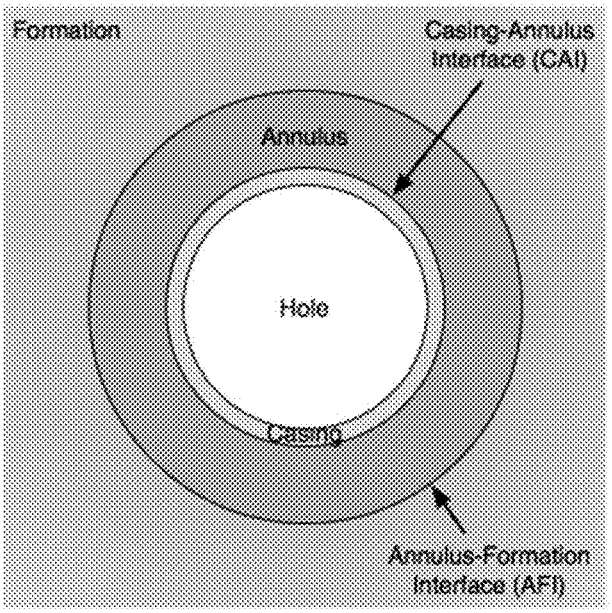
FIGS. 11A and 11B are schematic illustrations of a cased well.
Figure 11B:
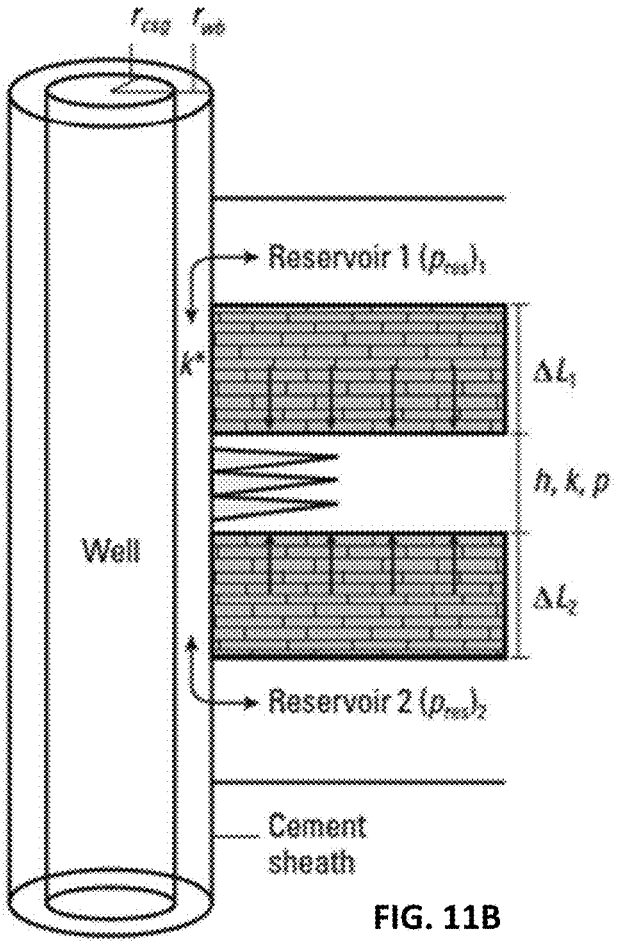

A Factor Graph can be used for probabilistic interference and analysis of a variety of aspects of a reservoir, such as the integrity of the cement casing of a wellbore. FIGS. 11A and 11B illustrate a cased well. FIG. 11A shows a cross-section of the cased well where the plane of the cross-section is parallel to the axis of the borehole. The casing is separated from the surrounding rock formation by cement. If the casing is perforated to allow fluids to flow into the well from the formation, then it is crucial to isolate this zone from the adjacent zones (Reservoir 1 and 2 in FIG. 11B), otherwise undesirable fluids (e.g., water) will flow into the well from these zones. If fluids can flow from an adjacent zone to the perforated interval then there exists an Effective Permeable Path (EPP). The goal of a good cement job is to have no EPP. There are at least five possible paths for fluids to flow from an adjacent zone:

- a path in the annulus (PA)—this could be due to the absence of cement in the zone, or continuous fractures or other gaps in the cement.
- a path in the formation (PF)—this could be due to fractures induced in the rock during the drilling, casing or cementing process.
- a path on the casing—annulus interface (PCAI)—this could be due to a poor bond on the interface.
- a path on the annulus—formation interface (PAFI)—this could be due to a poor bond on the interface.
- a path through the casing (PTC)—this could be due to damaged or otherwise compromised casing.

Figure 11C:
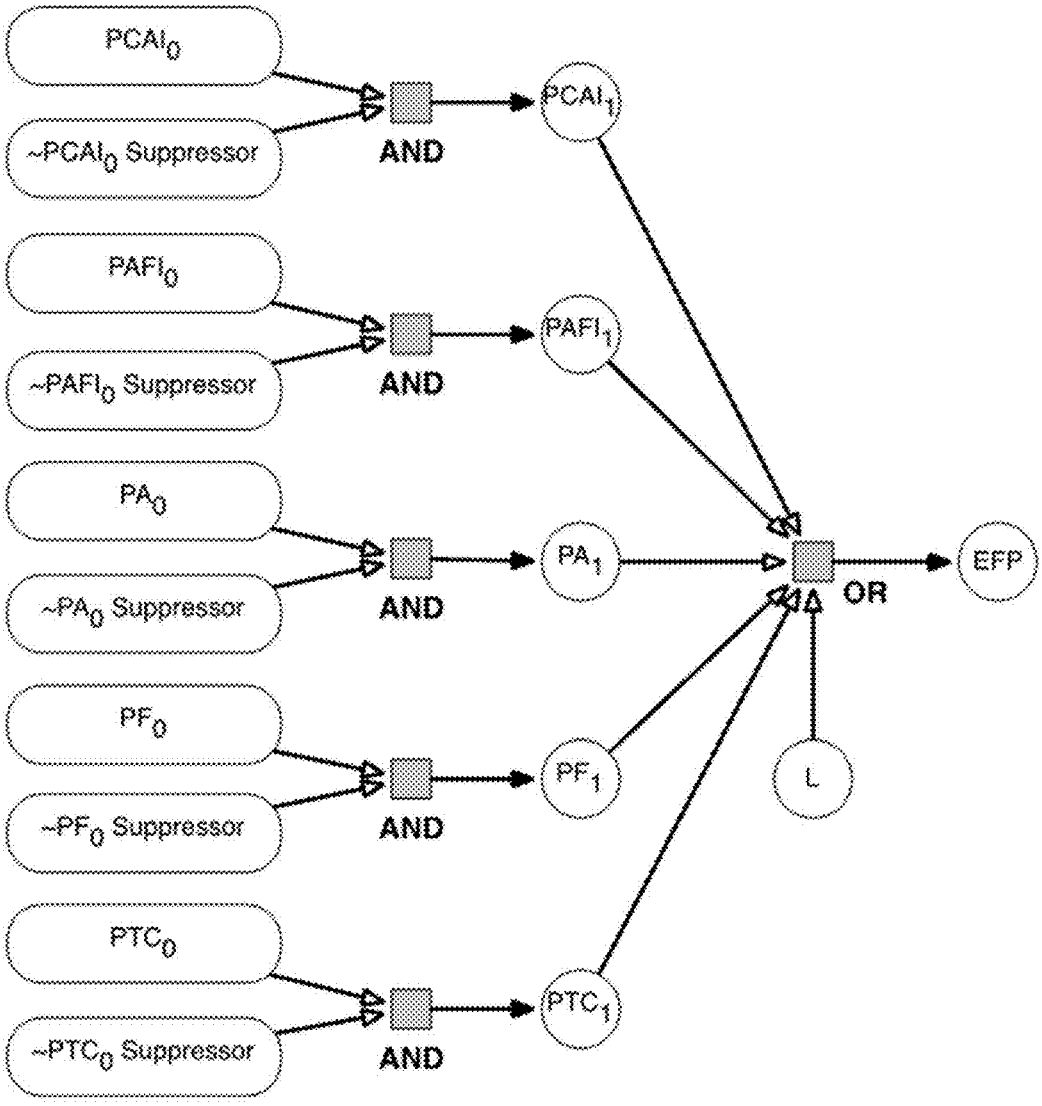
FIG. 11C illustrates an example Factor Graph that can be used for probabilistic interference and analysis of the integrity of the cement casing of a wellbore.

Any of these paths alone could be responsible for an EPP from an adjacent formation to the perforation. Many factors combine to cause any one of these paths to result in an EPP between an adjacent reservoir and the zone of interest. A Factor Graph can be used for probabilistic analysis to determine the existence of any of these paths. An example of such a Factor Graph is shown in FIG. 11C. In this example, a Noisy OR gate is used to combine the five path estimates (PA, PF, PCAI, PAFI and PTC) to yield a probability for an EPP. The unrolled version for the five paths is illustrated in FIG. 11C, which is equivalent to the Noisy OR gate of FIG. 7D according to the following:

$C=[PA_0,PF_0,PCAI_0,PAFI_0,PTC_0]$ $Q=[PA_0\text{Suppressor},PF_0\text{Suppressor},PCAI_0\text{Suppressor},PAFI_0\text{Suppressor},PTC_0\text{Suppressor}]$ $B=[PA_1,PF_1,PCAI_1,PAFI_1,PTC_1]$ $E=EPP$ $N=5$ Thus, in addition to evaluating the probabilities for each of the 5 independent paths, the corresponding suppressor probabilities are supplied, along with the leak probability (L), which is the low probability that a phenomenon other than the 5 paths is responsible for an EPP.

Figure 11D:
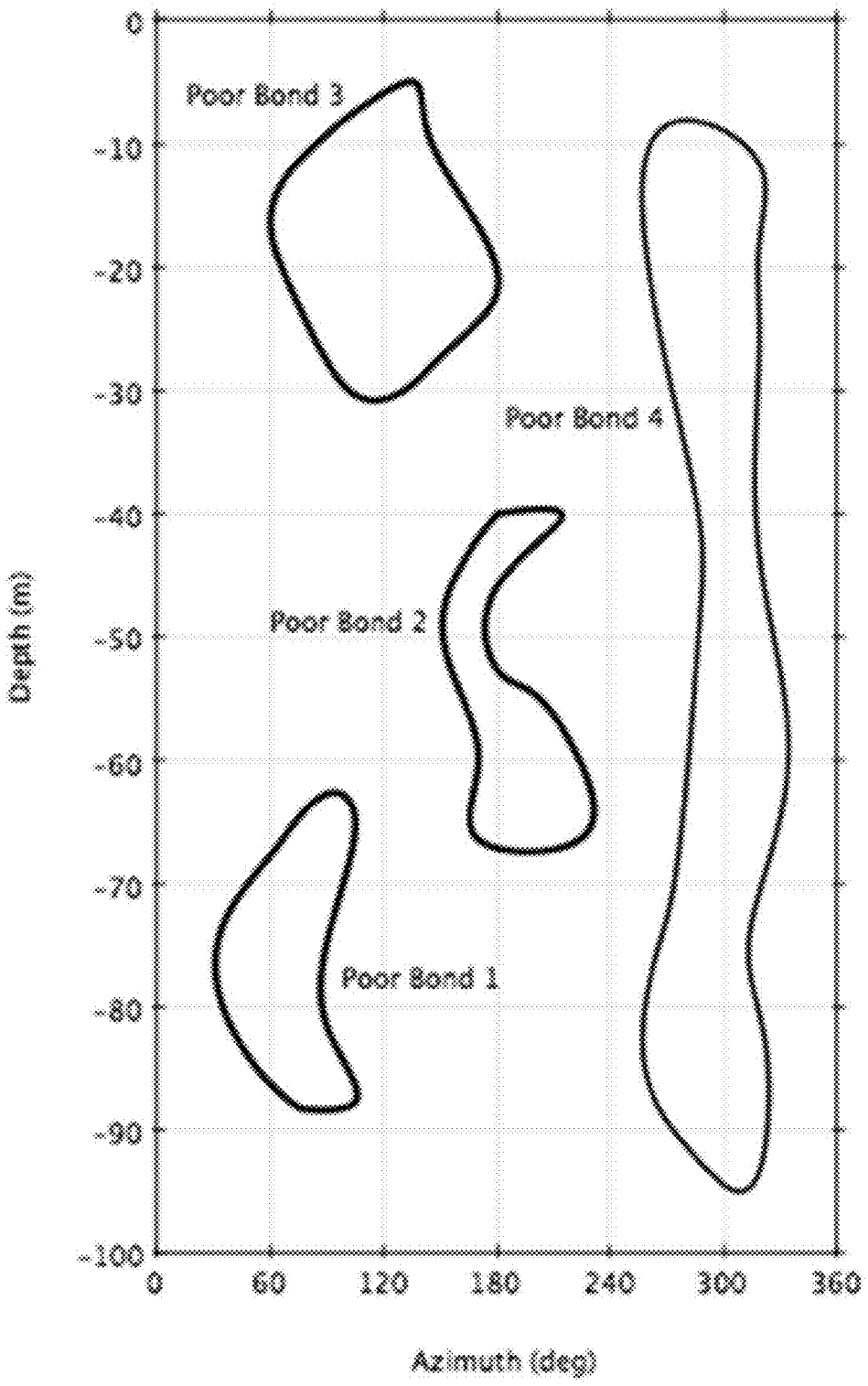
FIG. 11D is an unwrapped image of the casing-annulus interface that results from the probabilistic interference and analysis using the Factor Graph of FIG. 11C, with the vertical axis representing depth along the borehole and the horizontal axis representing azimuth around the borehole axis.

The Factor Graph of FIG. 11C also illustrates the flexibility of the Factor Graph approach to integrate multiple scales. Consider the sub-workflow of determining a path along the casing-annulus interface (PCAI). If we evaluate the interface using an acoustic log after the cement job is complete, an estimate of the quality of the bond can be obtained at a fine depth resolution e.g., 1 cm intervals. However, the cement job will span a much greater interval e.g., 100 m. Further, if engineering considerations determine that the absence of a PCAI of at least 20 m is sufficient to isolate the zone, then the question becomes whether then is a PCAI greater than 80 m (100 m-20 m). Thus, the continuity of poor bond quality observed at the 1 cm scale is integrated over the entire interval to determine the maximum length of a permeable path. This is illustrated in FIG. 11D, which is an unwrapped image of the casing-annulus interface with the vertical axis representing depth along the borehole and the horizontal axis representing azimuth around the borehole axis. Here, four patches on the interface have been identified to have poor bond. Only one of these patches (number 4) is potentially problematic because it appears to extend over 80 m.

Note that the probabilities for each of the potential paths are treated in a similar manner by generating azimuthal maps and determining the effective geometry of permeable pathways. Communication between paths on adjacent maps is also considered.

FIG. 12 shows an example of a Factor Graph that can be used for probabilistic reservoir simulation. Such simulation can be part of the planning and development of a reservoir, which typically includes the generation of a Field Development Plan (FDP) that integrates information about the reservoir such as structure, porosity and permeability along with potentially dynamic reservoir properties prior to the completion of any new wells such as reservoir water saturation and pressure. These reservoir properties are used as inputs to a reservoir simulator in order to estimate the amount of oil or gas produced by each well, i.e., the value of each well. The costs of creating and operating the new and existing wells are also considered. These costs and values can then be combined to compute the Net Present Value (NPV) of each well and hence the NPV for the entire field.

In the Factor Graph of FIG. 12, the reservoir is represented by the static properties of porosity and permeability, while the dynamic properties are represented by saturation and pressure at the initial time (Time 0). The wells are represented as plates of cardinality N (the number of wells). In addition to geometry and completion type, the wells have target production and injection properties and other constraints such as minimum bottom hole pressure (BHP). The reservoir properties and N wells are combined by the reservoir simulator to generate saturation and pressure properties from Time 0 to Time 1. In addition, the simulator forecasts production and injection performance for each well. The costs and values for each well are combined to evaluate NPV on each well, and further aggregated to compute NPV for the entire FDP.

The workflow represented in the Factor Graph applies equivalently to a deterministic or probabilistic workflow. In a deterministic workflow, none of the variables have uncertainty, while in a probabilistic workflow some of the variables will have uncertainty.

When generating an FDP, the static and initial dynamic reservoir properties are known with some uncertainty and a probabilistic value or NPV is computed by propagating belief forward through the Factor Graph. However, in other cases the value or production history of existing wells is known and these observations are used to improve the model of the reservoir, which is termed History Matching (HM). In this case, the production history observations of well performance from Time 0 to Time 1 may have been observed and probabilistic inference workflow as described herein can be applied to the Factor Graph of FIG. 12 to infer a posterior model for the reservoir properties.

Figure 13:
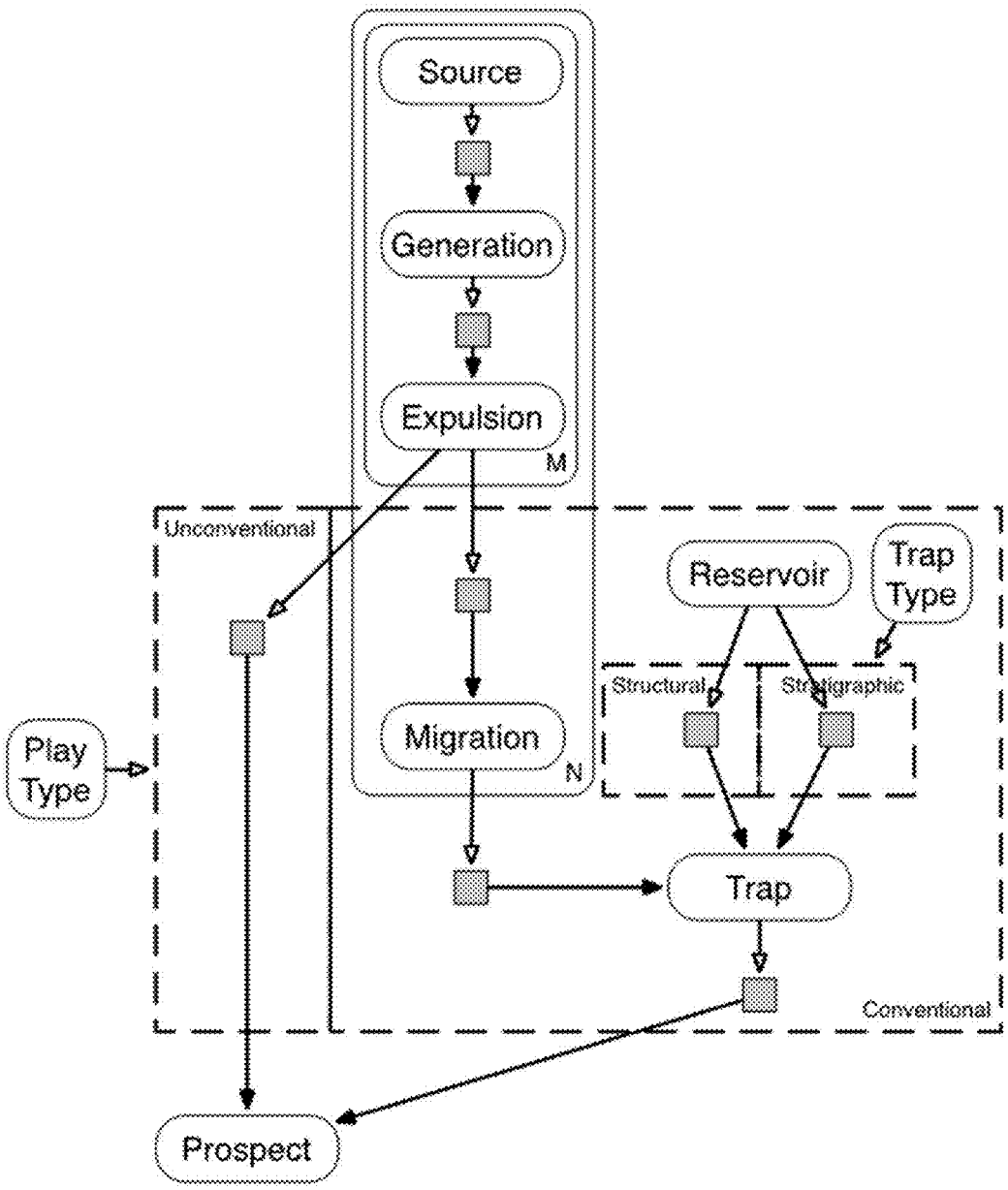
FIG. 13 shows an example of a Factor Graph that can be used for identification of a viable prospect reservoir.

FIG. 13 shows an example of a Factor Graph that can be used for identification of a viable prospect reservoir. During petroleum exploration, numerous factors are considered and evaluated to determine the existence of a viable prospect reservoir. Once a prospect is considered probable, then one or more exploration wells may be drilled.

The factors that are considered and evaluated to determine the existence of a viable prospect reservoir can include on or more of the following:

- the presence of source rock where organic material has been deposited in an anoxic environment to avoid premature decay resulting in sufficient Total Organic Carbon (TOC);
- the presence of source rock that has experienced a burial history to the right temperatures for oil or gas to be generated;

expulsion of the hydrocarbons from the source rock, such as by pressure build-up and micro fracturing of the source rock;

a migration pathway for the hydrocarbons from the source rock to the porous reservoir; and the existence of a structural or stratigraphic trap to prevent the migrating hydrocarbons from escaping the reservoir and ultimately being lost at the earth's surface.

In unconventional reservoirs, the generated hydrocarbons have not been expelled from the source rock nor have they experienced the complex migration and entrapment as in conventional oil and gas plays. In fact, the less expulsion that has taken place, the greater the amount of generated hydrocarbons remaining in the source rock.

These causal relationships for both conventional and unconventional prospects are illustrated in the example Factor Graph of FIG. 13. It is recognized that large and complex workflows may be associated with evaluating any of the variables in the Factor Graph of FIG. 13. These workflows may also be modeled and represented as probabilistic models. In the Factor Graph of FIG. 13, gates are used to distinguish between conventional and unconventional, along with distinguishing between trap type. A plate is used to model the possibility that more than one migration path and source rock may contribute hydrocarbons to the trap. Or, as is often the case, the source rock and migration pathway may be poorly understood.

Note that some evidence may dominate the probability of a viable prospect being present. For example, direct imaging of hydrocarbons with 3D seismic gives confidence in the presence of a prospect from which trap and reservoir can be inferred. However, while source rock deposition, hydrocarbon generation, expulsion, and migration therefore have occurred, we may not have with high confidence the nature and location of these events.

In one aspect, some of the methods and processes described above, such as the operations of the computation framework of the present disclosure, can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, or general purpose computer) for executing any of the methods and processes described above. The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Although only a few examples have been described in detail above, those skilled in the art will readily appreciate that many modifications are possible in the examples without materially departing from this subject disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method of modeling an aspect of a hydrocarbon-containing reservoir, the method comprising:

performing one or more oilfield operations carried out with respect to the hydrocarbon-containing reservoir;

constructing a first factor graph having variables and factors that describe the aspect of the hydrocarbon-containing reservoir, wherein the first graph includes at least one probabilistic factor implemented as one of a conditional probability table and a forward modeling simulator;

converting the first factor graph to a tree-structured graph that does not have any cycles or loops;

converting the tree-structured graph to a second factor graph that does not contain any cycles or loops, wherein the second factor graph has variables and factors that describe the aspect of the hydrocarbon-containing reservoir;

processing a query on the second factor graph, wherein the processing of the query involves message passing operations that perform probabilistic inference on the second factor graph with regard to the aspect of the hydrocarbon-containing reservoir that is modeled by the second factor graph, wherein a value for at least one variable of the second factor graph is derived from the one or more oilfield operations carried out with respect to the hydrocarbon-containing reservoir, wherein the query is a query type selected from the group consisting of a maximum posterior hypothesis query, and an analysis that compares hypotheses; and drilling one or more exploration wells, based upon, at least in part, data obtained from the second factor graph.

2. A method according to claim 1, wherein:

a subset of the variables of the second factor graph are probabilistic variables that account for uncertainty associated therewith.

3. A method according to claim 2, wherein:
the message passing operations are configured to update the probabilistic variables of the second factor graph based on the factors of the second factor graph.

4. A method according to claim 1, wherein:
the probabilistic inference performed on the second factor graph involves at least one operation selected from the group including i) the computation of a marginal distribution of a single probabilistic variable; ii) the joint distribution of several probabilistic variables; and iii) drawing random samples from a probability distribution with respect to the probabilistic variables of the second factor graph.

5. A method according to claim 1, wherein:
the query is a query type selected from the group consisting of a probability of evidence query, a marginalization query, a most probable explanation query, and a sensitivity analysis.

6. A method according to claim 1, further comprising:
using results of the probabilistic inference on the second factor graph for decision making with regard to the aspect of the hydrocarbon-containing reservoir that is modeled by the second factor graph while accounting for uncertainty therein.

7. A method according to claim 1, wherein:
the variables of the first factor graph include at least one class of variables selected from the group including i) objective variables; ii) intervention variables; iii) intermediate variables; iv) control variables; v) implementation variables; vi) additional input variables; and vii) measurement variables.

8. A method according to claim 1, wherein:
the variables of the first factor graph represents a data type selected from the group including continuous numbers, discrete numbers, categorical data, and binary data.

9. A method according to claim 1, wherein:
the first factor graph includes at least one element selected from the group including i) a noisy OR gate with at least one suppression variable and a leak variable; ii) a plate that is used to represent repeated instances of a sub-graph; iii) at least one gate that allows support for categorical variables, mixture models, and interventions; iv) at least one noise variable that represents uncertainty with regard to a measured variable; and v) at least one variable that represent accuracy or trueness with regard to a measured variable.

10. A method according to claim 1, wherein:
the first factor graph is converted to the tree-structured graph by
i) converting the first factor graph to a directed graph by removing the factors;
ii) converting the directed graph to an undirected graph through moralization;
iii) triangulating the undirected graph;
iv) identifying maximal cliques in the triangulated undirected graph; and
v) generating a junction graph from the triangulated undirected graph and the maximal cliques; and
vi) converting the junction graph to a junction tree.

11. A method according to claim 10, wherein:
the second junction graph is constructed from the junction tree derived from the first factor graph.

12. A system comprising:
a processor; and
a memory storing instructions executable by the processor to perform processes that include:
converting a first factor graph to a tree-structured graph that does not have any cycle or loops, wherein the first factor graph includes variables and factors that describe the aspect of the hydrocarbon-containing reservoir, wherein the first graph includes at least one probabilistic factor implemented as one of a conditional probability table and a forward modeling simulator;
converting the tree-structured graph to a second factor graph that does not contain any cycles or loops, wherein the second factor graph has variables and factors that describe the aspect of the hydrocarbon-containing reservoir;
processing a query on the second factor graph, wherein the processing of the query involves message passing operations that perform probabilistic inference on the second factor graph with regard to the aspect of the hydrocarbon-containing reservoir that is modeled by the second factor graph, wherein the query is a query type selected from the group consisting of a maximum posterior hypothesis query, and an analysis that compares hypotheses; and
visually displaying, at a display screen or a plot, one or more results from
the processing of the query; and
a drilling tool configured to drill one or more exploration wells, based upon, at least in part, data obtained from the second factor graph.

13. A system according to claim 12, wherein:
a subset of the variables of the second factor graph are probabilistic variables that account for uncertainty associated therewith.

14. A system according to claim 13, wherein:
the message passing operations are configured to update the probabilistic variables of the second factor graph based on the factors of the second factor graph.

15. A system according to claim 12, wherein:
the probabilistic inference performed on the second factor graph includes at least one operation selected from the group consisting of: i) the computation of a marginal distribution of a single probabilistic variable; ii) the joint distribution of several probabilistic variables; and iii) drawing random samples from a probability distribution with respect to the probabilistic variables of the second factor graph.

16. A system according to claim 12, wherein:
the query is a query type selected from the group consisting of a probability of evidence query, a marginalization query, a most probable explanation query, and a sensitivity analysis.

17. A system according to claim 12, wherein:
a value for at least one variable of the second factor graph is derived from oilfield operations carried out with respect to the hydrocarbon-containing reservoir.

18. A system according to claim 12, wherein:
the results of the probabilistic inference on the second factor graph are output for decision making with regard to the aspect of the hydrocarbon-containing reservoir that is modeled by the second factor graph while accounting for uncertainty therein.

* * * * *